US010479550B2

(12) United States Patent
Bechtel et al.

(10) Patent No.: US 10,479,550 B2
(45) Date of Patent: Nov. 19, 2019

(54) PACKAGING AND METHOD OF OPENING

(71) Applicant: KRAFT FOODS R & D, INC., Deerfield, IL (US)

(72) Inventors: Scott Bechtel, Deerfield, IL (US); Oksana Lapierre, Deerfield, IL (US); Paul Mutter, Deerfield, IL (US)

(73) Assignee: KRAFT FOODS R & D, INC., Deerfield, IL (US)

( * ) Notice: Subject to any disclaimer, the term of this patent is extended or adjusted under 35 U.S.C. 154(b) by 0 days.

(21) Appl. No.: 14/388,127

(22) PCT Filed: Mar. 26, 2013

(86) PCT No.: PCT/GB2013/050790
§ 371 (c)(1),
(2) Date: Sep. 25, 2014

(87) PCT Pub. No.: WO2013/144612
PCT Pub. Date: Oct. 3, 2013

(65) Prior Publication Data

US 2015/0314949 A1 Nov. 5, 2015

(30) Foreign Application Priority Data

Mar. 26, 2012 (GB) ..... 1205243.7

(51) Int. Cl.
*B65D 8/18* (2006.01)
*B65D 17/28* (2006.01)
(Continued)

(52) U.S. Cl.
CPC ..... *B65D 11/02* (2013.01); *B65B 5/02* (2013.01); *B65B 5/04* (2013.01); *B65B 7/2842* (2013.01);
(Continued)

(58) Field of Classification Search
CPC ..... B65D 25/52; B65D 17/02; B65D 17/06; B65D 17/168; B65D 11/02; B65D 17/20;
(Continued)

(56) References Cited

U.S. PATENT DOCUMENTS 1,419,905 A 6/1922 Hostetter
1,684,421 A 11/1922 Thompson
(Continued)

FOREIGN PATENT DOCUMENTS

AU 704843 B2 10/1996
AU 717400 B2 4/1997
(Continued)

OTHER PUBLICATIONS

GB Search Report GB1205243.7 dated Jul. 26, 2012.
(Continued)

*Primary Examiner* — J. Gregory Pickett
*Assistant Examiner* — Niki M Eloshway
(74) *Attorney, Agent, or Firm* — Cantor Colburn LLP

(57) ABSTRACT

A crack-propagation line is separate from a seal joining two shells of a confectionery packaging. The confectionery packaging is opened by separating the packaging along the crack-propagation line such that a portion of at least one of the parts of the confectionery packaging is broken to form an opening through which the packaged confectionery can be removed. Consequently, there is provided a method of forming a confectionery packaging and a method of packaging a confectionery product wherein two shells of a confectionery packaging are sealed together and a crack-propagation line is formed in a portion of at least one of the parts of the confectionery packaging. Suitably, the crack-propagation line extends away from the seal joining the two parts. The confectionery packaging is opened by separating at least one of the parts of the confectionery packaging,
(Continued)

leaving the seal substantially unaffected. The additional step of forming a separate crack-propagation line rather than intending the confectionery packaging to be opened by separating the two parts through the seal provides improved opening characteristics.

36 Claims, 6 Drawing Sheets

(51) Int. Cl.

| | |
|---|---|
| ***B65D 8/00*** | (2006.01) |
| ***B65B 5/02*** | (2006.01) |
| ***B65B 5/04*** | (2006.01) |
| ***B65B 7/28*** | (2006.01) |
| ***B65B 61/18*** | (2006.01) |
| ***B65B 69/00*** | (2006.01) |
| ***B65D 65/38*** | (2006.01) |
| ***B65D 77/32*** | (2006.01) |
| ***B65D 85/60*** | (2006.01) |
| ***B65D 17/46*** | (2006.01) |
| *B65D 17/34* | (2006.01) |

(52) U.S. Cl.
CPC ..... *B65B 61/18* (2013.01); *B65B 69/00* (2013.01); *B65D 17/402* (2018.01); *B65D 17/462* (2018.01); *B65D 65/38* (2013.01); *B65D 77/32* (2013.01); *B65D 85/60* (2013.01)

(58) Field of Classification Search
CPC ..... B65D 65/38; B65D 77/32; B65D 85/60; B65B 5/02; B65B 5/04; B65B 7/2842; B65B 61/18; B65B 69/00
USPC ..... 220/4.21, 4.24, 4.25
See application file for complete search history.

(56) References Cited

U.S. PATENT DOCUMENTS 3,127,993 A 4/1964 Phipps
3,161,156 A * 12/1964 Batista ..... A23G 3/0273 220/23.4
3,164,478 A 1/1965 Bostrom
3,292,840 A * 12/1966 Schmidt ..... B65D 11/02 206/776
3,472,368 A 10/1969 Hellstrom
3,741,379 A * 6/1973 Kappler ..... B65D 55/02 206/457
3,983,658 A * 10/1976 de Sanz ..... A63H 37/00 206/315.1
4,221,293 A 9/1980 Anthony
4,244,470 A 1/1981 Burnham
4,844,243 A 7/1989 Stiles
4,921,137 A * 5/1990 Heijenga ..... B65D 75/5811 222/107
5,176,272 A 1/1993 Ryan
5,209,345 A * 5/1993 Haugabook ..... G09B 19/00 206/1.5
5,287,979 A * 2/1994 Bourgeois ..... A47G 19/28 206/509
5,360,133 A 11/1994 Corby et al.
5,411,178 A * 5/1995 Roders ..... A47K 5/1215 222/105
5,480,091 A 1/1996 Stout
5,529,224 A * 6/1996 Chan ..... B65D 75/58 222/107
5,538,131 A 7/1996 Harrelson
5,634,569 A 6/1997 DeCoster
5,639,017 A 6/1997 Fogle
D380,381 S 7/1997 Krupa et al.
D381,263 S 7/1997 O'Brien et al.
D382,795 S 8/1997 Abayhan et al.
D382,796 S 8/1997 Mangla
D385,784 S 11/1997 Krupa et al.
5,685,420 A 11/1997 Martin et al.
D388,324 S 12/1997 Bonnard
D392,883 S 3/1998 Ferrin
D393,204 S 4/1998 Goins et al.
D394,807 S 6/1998 Krupa et al.
D395,599 S 6/1998 Wyslotsky
5,775,161 A 7/1998 Caleffi et al.
5,779,079 A 7/1998 Lee
D396,633 S 8/1998 Guillin
D397,610 S 9/1998 Cooper
D398,844 S 9/1998 Oberloier
D398,845 S 9/1998 Wyslotsky
D398,846 S 9/1998 Wyslotsky
5,839,609 A * 11/1998 Zakensberg ..... B65D 75/32 222/107
5,839,634 A 11/1998 Pollard et al.
5,850,964 A 12/1998 Rosenbaum et al.
D404,642 S 1/1999 Major
5,860,590 A 1/1999 Blomfield et al.
5,881,721 A 3/1999 Bunce et al.
D409,085 S 5/1999 Wyslotsky et al.
5,906,313 A 5/1999 Oliff
D411,741 S 6/1999 Wilson et al.
5,921,681 A 7/1999 Money
D412,843 S 8/1999 Melzer
5,941,453 A 8/1999 Oliff
5,955,099 A 9/1999 White
5,992,619 A 11/1999 Milano
6,000,539 A 12/1999 Stewart-Cox et al.
D418,410 S 1/2000 Smith
6,015,084 A 1/2000 Mathieu et al.
6,018,299 A 1/2000 Eberhardt
6,032,502 A 3/2000 Halasz et al.
6,050,402 A 4/2000 Walter
6,050,438 A * 4/2000 Kovens ..... B65D 11/02 220/4.24
6,065,590 A 5/2000 Spivey
6,065,602 A 5/2000 Nielsen
6,079,249 A 6/2000 Turner et al.
6,079,618 A 6/2000 Hedberg et al.
D427,902 S 7/2000 Hayes et al.
6,085,942 A 7/2000 Redmond
6,092,687 A 7/2000 Hupp et al.
6,094,884 A 8/2000 Christensen et al.
6,099,872 A 8/2000 Whetstone, Jr.
6,113,961 A 9/2000 Polster
D431,459 S 10/2000 Lee
D431,461 S 10/2000 Glassman
D433,328 S 11/2000 Loughnane
D433,937 S 11/2000 Glassman
D436,532 S 1/2001 Richardson
D436,860 S 1/2001 Raso
6,179,147 B1 1/2001 Mogard et al.
D437,220 S 2/2001 Knutson et al.
D438,103 S 2/2001 Edwards et al.
6,182,847 B1 2/2001 Shu
D438,461 S 3/2001 Yamagishi
6,196,406 B1 3/2001 Ennis
D440,490 S 4/2001 Lizzio
6,209,742 B1 4/2001 Overholt et al.
6,216,905 B1 4/2001 Mogard et al.
6,220,779 B1 4/2001 Warner et al.
D445,673 S 7/2001 Richardson
D446,450 S 8/2001 Zettle et al.
D447,684 S 9/2001 Hogman
D448,283 S 9/2001 Chapman
6,283,221 B2 9/2001 Hurray et al.
D449,226 S 10/2001 Hedstrom et al.
6,296,120 B1 10/2001 Danko
6,315,123 B1 11/2001 Ikeda
6,352,033 B1 3/2002 Brede et al.
6,357,631 B1 * 3/2002 Zaksenberg ..... B65D 75/5811 222/212
6,367,651 B2 4/2002 Laib et al.
6,370,842 B1 4/2002 Moriyama et al.
6,382,447 B1 5/2002 Loeschen
6,394,296 B1 5/2002 Elvin-Jensen et al.

(56) References Cited

U.S. PATENT DOCUMENTS

D459,988 S 7/2002 Hogman
D459,989 S 7/2002 Hogman
6,427,908 B1 8/2002 Laker et al.
6,431,436 B1 8/2002 Evers
6,463,776 B1 10/2002 Enoki et al.
6,467,614 B1 10/2002 Tallier et al.
6,474,468 B1 11/2002 Griffith
6,484,550 B2 11/2002 Halasz et al.
D466,405 S 12/2002 Lee
6,499,329 B1 12/2002 Enoki et al.
6,501,046 B1 12/2002 Miller et al.
D469,690 S 2/2003 Pau
6,513,306 B1 2/2003 Milano
D472,803 S 4/2003 Saunders
6,554,181 B1 4/2003 Dammers et al.
6,557,700 B1 5/2003 Wharton
6,557,731 B1 * 5/2003 Lyon ..... B65D 75/5811 222/107
D475,288 S 6/2003 Hoffmann et al.
D475,581 S 6/2003 Lillelund et al.
D480,300 S 10/2003 Lee
D480,638 S 10/2003 Lee
D485,470 S 1/2004 Willis
6,683,289 B2 1/2004 Whitmore et al.
6,685,020 B2 2/2004 Briseboi et al.
6,688,832 B1 2/2004 Zysset
D487,563 S 3/2004 Ghatlia et al.
6,702,140 B1 3/2004 Sollo
D488,375 S 4/2004 Risgalla
D488,718 S 4/2004 Passerini
6,732,889 B2 5/2004 Oren et al.
6,736,260 B2 5/2004 Gomes et al.
6,736,287 B2 5/2004 Sauer et al.
D493,105 S 7/2004 Childs et al.
6,787,205 B1 9/2004 Aho et al.
6,793,094 B2 9/2004 Turnbough
6,808,351 B1 10/2004 Brown et al.
D500,442 S 1/2005 Chiang
D500,443 S 1/2005 Chiang
D502,095 S 2/2005 Tucker et al.
D502,869 S 3/2005 Clarke
D504,286 S 4/2005 De Cleir
6,877,600 B2 4/2005 Sutherland
D505,081 S 5/2005 Risgalla
6,887,030 B2 5/2005 Bowman et al.
D505,861 S 6/2005 Risgalla
D506,130 S 6/2005 Metaxatos
D506,146 S 6/2005 Hall
D506,147 S 6/2005 Hall
D506,926 S 7/2005 Halliday et al.
6,912,829 B2 7/2005 Costantini
D508,647 S 8/2005 Silver et al.
6,929,171 B1 8/2005 Thiersch
D509,727 S 9/2005 Suckle et al.
6,959,577 B2 11/2005 Jentzsch
6,959,834 B2 11/2005 McDonald
6,974,612 B1 12/2005 Frisk et al.
6,976,577 B2 12/2005 Devine
D515,915 S 2/2006 Karim
7,004,897 B2 2/2006 Spivey, Sr.
7,007,836 B2 3/2006 Smalley
7,017,796 B2 3/2006 Ishikawa
D520,357 S 5/2006 Terrasi
7,044,319 B2 5/2006 Overholt et al.
D522,857 S 6/2006 Tabeshnekoo
7,066,342 B2 6/2006 Baechle et al.
D524,642 S 7/2006 Suckle et al.
D524,645 S 7/2006 LaMasney
7,073,680 B2 * 7/2006 Boback ..... B65D 43/021 220/266
7,086,572 B2 8/2006 Socier et al.
7,090,317 B2 8/2006 Remmers
D528,908 S 9/2006 Faktorovich et al.
D530,197 S 10/2006 LaMasney
D531,022 S 10/2006 Au
D531,029 S 10/2006 Gomoll et al.
D531,894 S 11/2006 Ramirez et al.
D534,420 S 1/2007 Fager
D534,421 S 1/2007 Tanner
D534,423 S 1/2007 Tanner
7,159,760 B2 1/2007 Pluck et al.
D536,611 S 2/2007 Peck
D536,992 S 2/2007 Garg et al.
D539,134 S 3/2007 Wallach
7,191,931 B2 3/2007 Damkjaer
D540,663 S 4/2007 Tanner
7,208,009 B2 4/2007 Richter
D542,675 S 5/2007 Luxton et al.
7,211,035 B2 5/2007 Ichikawa et al.
D547,176 S 7/2007 Sansoldo
D549,571 S 8/2007 Althouse et al.
D550,077 S 9/2007 Lagreca et al.
D550,553 S 9/2007 Yalinkaya
7,270,245 B2 9/2007 Cheng et al.
D552,468 S 10/2007 Seum et al.
D552,982 S 10/2007 Liebe
D553,489 S 10/2007 Lambert et al.
D553,490 S 10/2007 Yang
7,284,662 B2 10/2007 DeBusk et al.
7,287,645 B2 10/2007 Hyun
D554,498 S 11/2007 Lovett
D556,569 S 12/2007 Stein et al.
D556,571 S 12/2007 Jalet
D557,601 S 12/2007 Minidis
7,314,462 B2 1/2008 Richter et al.
7,314,482 B2 1/2008 Richter et al.
D561,579 S 2/2008 Aronson et al.
D562,128 S 2/2008 Van de Velde
D562,678 S 2/2008 Shaver et al.
7,325,686 B2 2/2008 Aldridge
D564,349 S 3/2008 Schumaier
D564,899 S 3/2008 Hardy
7,357,272 B2 4/2008 Maxwell
D569,243 S 5/2008 Kidd et al.
D569,269 S 5/2008 LaMasney
7,370,774 B2 5/2008 Watson et al.
D571,228 S 6/2008 Maslowski
D571,654 S 6/2008 Maroofian et al.
D571,656 S 6/2008 Maslowski
7,383,954 B2 6/2008 Morrison
7,389,875 B2 6/2008 Sandberg et al.
D572,582 S 7/2008 Lymn et al.
D573,015 S 7/2008 Chen
7,392,683 B2 7/2008 Luthi et al.
D576,875 S 9/2008 Steiger et al.
D577,577 S 9/2008 Lee et al.
D577,578 S 9/2008 Lymn et al.
D577,579 S 9/2008 Lymn et al.
7,419,068 B2 9/2008 Bushby
D577,995 S 10/2008 Lovett
D578,387 S 10/2008 Lovett
D578,388 S 10/2008 Lymn et al.
D578,877 S 10/2008 Lovett
D579,326 S 10/2008 Chen
D579,767 S 11/2008 Wallach
D580,750 S 11/2008 Claassen et al.
D581,266 S 11/2008 Vovan
7,456,376 B2 11/2008 Berthault
D581,781 S 12/2008 Enriquez
D583,657 S 12/2008 Follansbee et al.
D583,658 S 12/2008 Follansbee et al.
D583,659 S 12/2008 Lyon et al.
D584,964 S 1/2009 Schulz et al.
7,475,777 B2 1/2009 Fung et al.
D585,734 S 2/2009 Doliwa
D585,735 S 2/2009 Vovan et al.
D586,665 S 2/2009 Murgida et al.
D587,108 S 2/2009 Maslowski
7,484,641 B2 2/2009 Casale et al.
D587,567 S 3/2009 Peyser et al.
D587,993 S 3/2009 Vovan
D588,932 S 3/2009 Murray
D589,340 S 3/2009 Busse et al.
D589,341 S 3/2009 Busse et al.

(56) References Cited

U.S. PATENT DOCUMENTS

D589,342 S 3/2009 Maslowski
D589,790 S 4/2009 Shaver et al.
D589,796 S 4/2009 McGeough
7,520,959 B2 4/2009 Kikuchi
D592,494 S 5/2009 Wichowski
D592,497 S 5/2009 Brown
7,527,152 B2 5/2009 Lentner et al.
7,549,550 B2 6/2009 Smyers et al.
7,552,833 B2 6/2009 Tsutsui et al.
D596,935 S 7/2009 Golota et al.
D596,954 S 7/2009 Jimenez et al.
D601,010 S 9/2009 Ballard et al.
D601,011 S 9/2009 Maslowski
D601,013 S 9/2009 Petitjean
D601,014 S 9/2009 Petitjean
D601,015 S 9/2009 Shaver et al.
D601,304 S 9/2009 McClellan
7,582,242 B2 9/2009 Kolanus
D601,884 S 10/2009 Andre et al.
7,597,244 B2 10/2009 Boldrini et al.
7,604,117 B2 10/2009 Bourgoin et al.
D605,501 S 12/2009 Pham et al.
D605,530 S 12/2009 Sorrentino et al.
D606,392 S 12/2009 Prevost
7,624,673 B2 12/2009 Zanetti
7,628,296 B2 12/2009 Rudolph
D608,192 S 1/2010 L'Hoste et al.
D609,085 S 2/2010 Brachman et al.
D609,561 S 2/2010 Baker et al.
7,661,564 B2 2/2010 Delbarre
D611,805 S 3/2010 Barniquel
D614,490 S 4/2010 Ouimette et al.
D614,491 S 4/2010 Rhoad
7,699,163 B2 4/2010 Gomes et al.
D614,948 S 5/2010 Lablaine et al.
D614,950 S 5/2010 Colacitti
D615,395 S 5/2010 Jefferies et al.
D615,401 S 5/2010 Ouimette et al.
D615,858 S 5/2010 Prevost
D615,859 S 5/2010 Barbier
D616,738 S 6/2010 Andre et al.
D618,539 S 6/2010 Ruth
D618,540 S 6/2010 Ruth
D618,547 S 6/2010 Manning et al.
7,748,563 B2 7/2010 Turner et al.
7,757,843 B2 7/2010 Katsis
D620,790 S 8/2010 Lovett
D622,588 S 8/2010 Wichmann et al.
D622,617 S 8/2010 Sorrentino et al.
D623,935 S 9/2010 Kim et al.
D624,399 S 9/2010 Hansen et al.
D624,402 S 9/2010 Hansen et al.
D624,403 S 9/2010 Hansen et al.
D624,785 S 10/2010 Rousselin
D624,815 S 10/2010 Hansen et al.
D625,180 S 10/2010 Enriquez
7,806,314 B2 10/2010 Sutherland
7,819,249 B2 10/2010 Han
D627,221 S 11/2010 Kovatch
D628,062 S 11/2010 Snedden et al.
7,828,198 B2 11/2010 Boldrini et al.
7,832,075 B2 11/2010 De Guerry et al.
7,838,846 B2 11/2010 Pinsky
D628,470 S 12/2010 Golota et al.
D628,473 S 12/2010 Golota et al.
D628,475 S 12/2010 Snedden et al.
D628,478 S 12/2010 Snedden et al.
D628,479 S 12/2010 Snedden et al.
D630,091 S 1/2011 Schick
D631,337 S 1/2011 Prevost
D631,338 S 1/2011 Prevost
D631,371 S 1/2011 Borgheim et al.
7,862,318 B2 1/2011 Middleton et al.
7,870,980 B2 1/2011 Wilson et al.
7,871,651 B2 * 1/2011 Sinichko ..... A23G 1/505 220/4.01
7,874,421 B2 1/2011 Bardet
D632,167 S 2/2011 Sauriol et al.
D632,170 S 2/2011 Lawrence et al.
D632,955 S 2/2011 Smith, III et al.
D632,956 S 2/2011 Fuller et al.
D633,380 S 3/2011 Reynolds
D634,188 S 3/2011 Sellari et al.
D634,616 S 3/2011 Hansen et al.
D634,617 S 3/2011 Sellari et al.
D634,618 S 3/2011 Colacitti
D635,848 S 4/2011 Lawrence et al.
D636,258 S 4/2011 Freeman et al.
7,922,019 B2 4/2011 Granger
D637,482 S 5/2011 Snedden et al.
D637,483 S 5/2011 Snedden et al.
D637,484 S 5/2011 Winkler
D637,902 S 5/2011 Evon
D638,701 S 5/2011 Shapiro et al.
7,951,057 B2 5/2011 Robertson et al.
D639,156 S 6/2011 Guillemin et al.
D640,129 S 6/2011 Sifuentes et al.
D640,130 S 6/2011 Golota et al.
D640,544 S 6/2011 Sifuentes et al.
D640,547 S 6/2011 Guillemin et al.
D640,548 S 6/2011 Lawrence et al.
D640,550 S 6/2011 Snedden et al.
7,959,032 B2 6/2011 Bolli
D640,921 S 7/2011 Caldwell et al.
D641,233 S 7/2011 Pugh
D641,616 S 7/2011 Prevost
D641,642 S 7/2011 Caldwell et al.
7,975,989 B2 7/2011 Romanyszyn et al.
D643,311 S 8/2011 Meyers
D643,713 S 8/2011 Lawrence et al.
7,997,436 B2 8/2011 Bolli
7,998,047 B2 8/2011 Spivey, Sr. et al.
8,003,178 B2 8/2011 Kim et al.
D645,339 S 9/2011 Oakes
D645,737 S 9/2011 Oakes
D645,764 S 9/2011 Mathis et al.
D646,561 S 10/2011 Pugh
D646,564 S 10/2011 Freeman et al.
D646,969 S 10/2011 Snedden et al.
8,038,918 B2 10/2011 Jalet et al.
8,042,728 B2 10/2011 Braoudakis
D647,792 S 11/2011 Mathis et al.
D649,448 S 11/2011 Wu
8,051,982 B2 11/2011 McDonald
8,053,009 B2 11/2011 Bourguignon et al.
8,066,141 B2 11/2011 Casale et al.
D651,096 S 12/2011 Nakagiri
8,070,052 B2 12/2011 Spivey, Sr. et al.
D652,716 S 1/2012 Snedden et al.
8,087,526 B2 1/2012 Dovey et al.
8,091,703 B2 1/2012 Marchetti et al.
8,100,320 B2 1/2012 Brand
8,104,319 B2 1/2012 Turner et al.
D653,533 S 2/2012 Brachman et al.
D653,557 S 2/2012 Villa
D654,788 S 2/2012 Bougoulas et al.
D655,154 S 3/2012 Amos et al.
D655,201 S 3/2012 Schuch
D656,008 S 3/2012 Meech et al.
8,127,518 B2 3/2012 Ford
D656,843 S 4/2012 Schleining
D657,237 S 4/2012 Allers et al.
D658,055 S 4/2012 Kurita et al.
8,158,226 B2 4/2012 Oshita et al.
D658,979 S 5/2012 Gordon et al.
D660,718 S 5/2012 Mcdermott et al.
8,172,086 B2 5/2012 Aldridge et al.
8,177,068 B2 5/2012 Dias
8,196,805 B2 6/2012 Brand et al.
8,205,787 B2 6/2012 Panduro, Jr. et al.
8,210,538 B2 7/2012 Shoemaker, Jr.
8,231,001 B2 7/2012 Boon et al.
8,235,008 B2 8/2012 Axelrod et al.

(56) References Cited

U.S. PATENT DOCUMENTS

| | | | |
|---|---|---|---|
| 8,261,964 | B2 | 9/2012 | Raupach et al. |
| 8,272,559 | B2 | 9/2012 | Sutherland |
| 8,297,491 | B2 | 10/2012 | Kwok et al. |
| 8,302,809 | B1 | 11/2012 | Bogdziewicz, III et al. |
| 8,308,023 | B2 | 11/2012 | Gelardi et al. |
| 8,317,671 | B1 | 11/2012 | Zoeckler |
| 8,322,183 | B2 | 12/2012 | Myers et al. |
| 8,328,492 | B2 | 12/2012 | Turner et al. |
| 8,336,713 | B2 | 12/2012 | Poitevin |
| 8,348,051 | B2 | 1/2013 | Furey |
| 8,348,142 | B2 | 1/2013 | Smalley |
| 8,365,658 | B2 | 2/2013 | Ouchi |
| 8,371,445 | B2 | 2/2013 | Seabaugh et al. |
| 8,371,449 | B2 | 2/2013 | Berry et al. |
| 8,376,214 | B2 | 2/2013 | Spivey, Sr. et al. |
| 8,381,929 | B2 | 2/2013 | Kellerer et al. |
| 8,387,855 | B2 | 3/2013 | Brand |
| 8,393,469 | B2 | 3/2013 | Aldridge et al. |
| 8,408,412 | B2 | 4/2013 | Hong |
| 8,408,419 | B2 | 4/2013 | Rippl et al. |
| 8,413,805 | B2 | 4/2013 | Bray et al. |
| 8,439,194 | B2 | 5/2013 | Spivey |
| 8,439,198 | B2 | 5/2013 | Hines |
| 8,444,046 | B2 | 5/2013 | Debusk et al. |
| 8,459,088 | B2 | 6/2013 | Coates |
| 8,459,190 | B2 | 6/2013 | Erdie |
| 8,469,259 | B2 | 6/2013 | Clement et al. |
| 8,480,035 | B2 | 7/2013 | Goddard et al. |
| 8,490,858 | B2 | 7/2013 | Timbrook et al. |
| 8,505,716 | B2 | 8/2013 | Van Liempd |
| 8,511,463 | B2 | 8/2013 | Brand |
| 8,511,467 | B2 | 8/2013 | Sorrentino et al. |
| D689,694 | S | 9/2013 | Barth |
| 8,528,807 | B2 | 9/2013 | Kaneko |
| 8,540,094 | B2 | 9/2013 | Riedl |
| 8,540,111 | B2 | 9/2013 | Middleton et al. |
| 8,550,035 | B2 | 10/2013 | Moreno et al. |
| 8,550,241 | B2 | 10/2013 | Holford |
| 8,555,692 | B2 | 10/2013 | Myers et al. |
| 8,556,071 | B2 | 10/2013 | Holloway et al. |
| 8,556,124 | B2 | 10/2013 | Edwards |
| 8,579,184 | B2 | 11/2013 | Pettersson et al. |
| 8,602,292 | B2 | 12/2013 | Brand |
| 8,607,974 | B2 | 12/2013 | De The et al. |
| 8,631,971 | B2 | 1/2014 | Edwards |
| 8,646,653 | B2 | 2/2014 | Lien et al. |
| 8,651,310 | B2 | 2/2014 | Orgeldinger |
| 8,657,163 | B2 | 2/2014 | Eriksson |
| 8,661,969 | B2 | 3/2014 | Ewald et al. |
| 8,662,333 | B2 | 3/2014 | Orgeldinger |
| 8,671,730 | B2 | 3/2014 | Ytsma |
| 8,672,184 | B2 | 3/2014 | Edwards |
| 8,714,407 | B2 | 5/2014 | Frank et al. |
| 8,720,736 | B2 | 5/2014 | Boland |
| 8,720,743 | B2 | 5/2014 | Smalley et al. |
| 8,733,572 | B2 | 5/2014 | Ruiz Carmona |
| 8,733,624 | B2 | 5/2014 | Rueda |
| 8,746,483 | B2 | 6/2014 | Sierra-Gomez et al. |
| 8,746,540 | B2 | 6/2014 | Hultberg et al. |
| 8,776,415 | B2 | 7/2014 | Kawaguchi et al. |
| 8,789,403 | B2 | 7/2014 | Egerton et al. |
| 8,794,503 | B2 | 8/2014 | Burgos Agudo |
| 8,800,761 | B2 | 8/2014 | Lutzig et al. |
| 8,807,365 | B2 | 8/2014 | Orgeldinger |
| 8,807,417 | B2 | 8/2014 | Valesini Gegembauer |
| 8,807,418 | B2 | 8/2014 | Ouillette |
| 8,813,965 | B2 | 8/2014 | Cheema et al. |
| 8,820,201 | B2 | 9/2014 | Marcos et al. |
| 8,827,145 | B2 | 9/2014 | Hultberg et al. |
| 8,833,235 | B2 | 9/2014 | Fabozzi et al. |
| 8,844,334 | B2 | 9/2014 | Roeterdink |
| 8,844,798 | B2 | 9/2014 | Linkel |
| 8,663,751 | B2 | 10/2014 | Demmer et al. |
| 8,851,279 | B1 | 10/2014 | Husmann |
| 8,851,323 | B2 | 10/2014 | Watson et al. |
| 8,851,362 | B2 | 10/2014 | Aksan et al. |
| 8,863,951 | B2 | 10/2014 | Erickson et al. |
| 8,863,952 | B2 | 10/2014 | Bates et al. |
| 8,869,979 | B2 | 10/2014 | Smalley |
| 8,875,878 | B2 | 11/2014 | Young |
| 8,875,924 | B2 | 11/2014 | Orgeldinger |
| 8,875,982 | B2 | 11/2014 | Quadrelli |
| 8,887,906 | B2 | 11/2014 | Holford |
| 8,893,955 | B2 | 11/2014 | Clark et al. |
| 8,899,418 | B2 | 12/2014 | Francis et al. |
| 8,915,365 | B2 | 12/2014 | Fath et al. |
| 8,936,149 | B2 | 1/2015 | Smalley |
| 8,960,527 | B2 | 2/2015 | Hui |
| D724,440 | S | 3/2015 | Ulstad et al. |
| 8,966,869 | B2 | 3/2015 | Hundeloh et al. |
| 8,967,380 | B2 | 3/2015 | Moncrief et al. |
| 9,016,492 | B2 | 4/2015 | Orgeldinger |
| 9,027,780 | B2 | 5/2015 | Attard |
| 9,033,210 | B2 | 5/2015 | Kastanek |
| 9,033,211 | B2 | 5/2015 | Zanini |
| 9,038,847 | B2 | 5/2015 | Hewitt et al. |
| 9,044,082 | B2 | 6/2015 | Kusuma et al. |
| 9,051,104 | B2 | 6/2015 | Heirman et al. |
| 9,051,106 | B2 | 6/2015 | Milano |
| 9,061,810 | B2 | 6/2015 | Brand |
| 9,067,713 | B2 | 6/2015 | Joy |
| 9,073,663 | B2 | 7/2015 | Holley, Jr. et al. |
| 9,073,665 | B2 | 7/2015 | Sanger |
| 9,073,680 | B2 | 7/2015 | Kastanek |
| 9,078,533 | B2 | 7/2015 | Hession |
| 9,079,239 | B2 | 7/2015 | Kojima et al. |
| 9,085,026 | B2 | 7/2015 | Mejia-Quinchia et al. |
| 9,090,390 | B2 | 7/2015 | Walling et al. |
| 9,096,345 | B2 | 8/2015 | Bogdziewicz et al. |
| 9,096,780 | B2 | 8/2015 | Zerfas et al. |
| 9,114,451 | B2 | 8/2015 | Chasteen et al. |
| 9,120,589 | B2 | 9/2015 | Hanan |
| 9,126,718 | B2 | 9/2015 | Lewis |
| 9,132,612 | B2 | 9/2015 | Bohrer |
| 9,132,936 | B2 | 9/2015 | Kohler |
| 9,132,974 | B2 | 9/2015 | Savage et al. |
| 9,139,346 | B2 | 9/2015 | Doyle |
| 9,162,564 | B2 | 10/2015 | Sakamoto et al. |
| 9,169,037 | B2 | 10/2015 | Pinkstone |
| 9,169,039 | B2 | 10/2015 | Freeman |
| 9,187,204 | B2 | 11/2015 | Mathieu et al. |
| 9,192,977 | B2 | 11/2015 | Widitora et al. |
| 9,199,774 | B2 | 12/2015 | Smalley et al. |
| 9,227,750 | B2 | 1/2016 | Franic |
| 9,227,751 | B2 | 1/2016 | Scrimger |
| 9,233,515 | B2 | 1/2016 | Cook et al. |
| 9,238,531 | B2 | 1/2016 | Himmelsbach et al. |
| 9,248,423 | B2 | 2/2016 | Cerasani |
| 9,265,287 | B2 | 2/2016 | Sims et al. |
| 9,272,819 | B1 | 3/2016 | Zabaleta et al. |
| 9,290,291 | B2 | 3/2016 | Hamdoun et al. |
| 9,302,812 | B2 | 4/2016 | Rees et al. |
| 9,309,023 | B2 | 4/2016 | Hubbard, Jr. et al. |
| 9,315,310 | B2 | 4/2016 | Bailey |
| 9,321,553 | B1 | 4/2016 | Spivey, Sr. et al. |
| D755,637 | S | 5/2016 | Wetton et al. |
| 9,327,338 | B2 | 5/2016 | Boysel et al. |
| 9,327,857 | B2 | 5/2016 | Scaliti et al. |
| 9,327,862 | B2 | 5/2016 | Barbieri et al. |
| 9,327,867 | B2 | 5/2016 | Stanley et al. |
| 9,334,078 | B2 | 5/2016 | Riley et al. |
| 9,334,079 | B2 | 5/2016 | Lindstrom et al. |
| 9,340,347 | B2 | 5/2016 | Holford |
| 9,346,234 | B2 | 5/2016 | Hajek et al. |
| 9,346,582 | B2 | 5/2016 | Pinkstone |
| 9,352,890 | B2 | 5/2016 | Alexander et al. |
| 9,359,106 | B2 | 6/2016 | Bogdziewicz, III et al. |
| 9,371,151 | B2 | 6/2016 | Nadeau |
| 9,382,040 | B2 | 7/2016 | Huang |
| 9,386,871 | B2 | 7/2016 | Domit |
| 9,387,530 | B2 | 7/2016 | Fowler et al. |
| 9,387,968 | B2 | 7/2016 | Zammit et al. |
| 9,394,093 | B2 | 7/2016 | Alexander et al. |
| 9,394,094 | B2 | 7/2016 | Holley, Jr. et al. |

(56) References Cited

U.S. PATENT DOCUMENTS 9,394,154 B2 7/2016 Connerat et al.
9,403,639 B2 8/2016 Bleile et al.
9,409,224 B2 8/2016 Roeterdink
9,415,278 B2 8/2016 Kabeshita
9,415,893 B2 8/2016 Wintermute et al.
9,415,915 B2 8/2016 Spivey, Sr. et al.
9,434,124 B2 9/2016 Belko et al.
9,434,520 B2 9/2016 Bates
9,452,860 B2 9/2016 Mehta
9,452,874 B2 9/2016 Harrelson
9,463,896 B2 10/2016 Fitzwater
9,475,606 B2 10/2016 Ball et al.
9,480,322 B2 11/2016 Mortis Simons
9,481,486 B2 11/2016 Nameth et al.
9,487,320 B2 11/2016 Holley, Jr.
9,487,324 B2 11/2016 Benko et al.
9,499,296 B2 11/2016 Mills et al.
9,499,306 B2 11/2016 Miller et al.
9,501,956 B2 11/2016 Fluharty
9,505,186 B2 11/2016 Yang
9,505,513 B2 11/2016 Wolters et al.
9,505,518 B2 11/2016 Mills et al.
9,511,411 B2 12/2016 Tielbeke et al.
9,511,894 B2 12/2016 Wilson et al.
9,512,524 B2 12/2016 Riesop
9,517,498 B2 12/2016 Siles et al.
9,533,791 B2 1/2017 Fath
9,540,137 B2 1/2017 Forrest et al.
9,540,165 B2 1/2017 Kastha et al.
9,546,017 B2 1/2017 Li
9,555,459 B2 1/2017 Monro et al.
9,555,948 B2 1/2017 Nemeth et al.
9,557,209 B2 1/2017 Savage et al.
9,567,131 B2 2/2017 Riva
9,580,203 B2 2/2017 Frank
9,592,942 B2 3/2017 Walling
9,598,202 B2 3/2017 Oliveira et al.
9,598,214 B2 3/2017 Holley, Jr.
9,604,767 B2 3/2017 Ramsuer
9,604,768 B2 3/2017 Ramsuer et al.
9,611,065 B2 4/2017 Franic
9,623,473 B2 4/2017 Friedrich et al.
9,623,996 B2 4/2017 Casale et al.
9,630,739 B2 4/2017 McMahon et al.
9,637,265 B2 5/2017 Kim
9,637,296 B1 5/2017 Corvisier
9,656,776 B2 5/2017 Sloat et al.
9,656,789 B2 5/2017 Requena
9,659,426 B2 5/2017 Bauer
9,663,282 B2 5/2017 Vogt et al.
9,666,230 B2 5/2017 Rossiter
9,682,793 B2 6/2017 Magnusson et al.
9,688,427 B2 6/2017 Melrose
9,694,935 B2 7/2017 Scott
9,700,163 B2 7/2017 Kobayashi
9,700,929 B2 7/2017 Fedusa et al.
9,701,444 B2 7/2017 Gallagher
9,707,615 B2 7/2017 Dick et al.
9,708,112 B2 7/2017 Sutherland et al.
9,714,134 B2 7/2017 Tacchi et al.
9,718,110 B2 8/2017 Butcher et al.
9,718,246 B2 8/2017 Holley, Jr. et al.
9,725,202 B2 8/2017 Minnette et al.
9,738,413 B2 8/2017 Humphrey et al.
9,751,283 B2 9/2017 Yamanaka et al.
9,758,275 B2 9/2017 Fitzwater et al.
9,771,493 B2 9/2017 Riesop
9,775,469 B2 10/2017 Rizzo
9,790,013 B2 10/2017 Loftin et al.
9,796,498 B2 10/2017 Wintermute et al.
9,796,525 B2 10/2017 Orgeldinger
9,809,363 B2 11/2017 Glinert et al.
9,834,328 B2 12/2017 Madsen
9,845,173 B2 12/2017 Herman
9,849,500 B2 12/2017 Presset et al.
9,849,501 B2 12/2017 Adams et al.
9,861,551 B2 1/2018 Taylor
9,868,582 B2 1/2018 Gilpatrick et al.
9,868,587 B2 1/2018 Martini et al.
9,873,539 B2 1/2018 Yamanaka et al.
9,873,540 B2 1/2018 Skinner
9,878,365 B2 1/2018 Caylor et al.
9,878,827 B2 1/2018 Exner et al.
9,889,370 B2 2/2018 Shigeta
9,894,886 B2 2/2018 Suh
9,895,737 B2 2/2018 Caunter et al.
9,901,222 B2 2/2018 Wilson et al.
9,901,972 B2 2/2018 Rayburn
9,919,855 B2 3/2018 Vogt et al.
9,938,043 B2 4/2018 Chasteen et al.
9,938,299 B2 4/2018 Selnick et al.
9,943,899 B2 4/2018 Pilon et al.
9,944,427 B2 4/2018 Phung
10,010,095 B2 7/2018 Vaccarella
2002/0033393 A1 3/2002 Fux
2002/0033397 A1* 3/2002 Henson ..... A63H 15/06 220/603
2002/0170868 A1 11/2002 Morgan
2003/0121924 A1 7/2003 Stodd
2003/0166368 A1 9/2003 Bushman et al.
2003/0192907 A1 10/2003 Bates
2004/0137202 A1 7/2004 Hamilton et al.
2004/0226267 A1 11/2004 Mansuino
2004/0247751 A1 12/2004 Vangertruyden
2005/0208186 A1 9/2005 Kirkland
2006/0062874 A1 3/2006 Sinichko et al.
2006/0140746 A1 6/2006 Koon
2006/0162292 A1 7/2006 Liempd Van
2006/0191929 A1 8/2006 Berg, Jr. et al.
2006/0191985 A1 8/2006 Norcom
2006/0231599 A1 10/2006 Matthews
2006/0237454 A1 10/2006 Clarke
2006/0273098 A1* 12/2006 Emalfarb ..... A01G 9/02 220/565
2006/0278559 A1 12/2006 Hamblin et al.
2007/0017915 A1* 1/2007 Weder ..... B65D 21/086 220/4.21
2007/0017962 A1 1/2007 Russ
2007/0039970 A1 2/2007 Ivey
2007/0152458 A1 7/2007 Guidetti
2007/0187273 A1 8/2007 Grosskopf
2008/0041752 A1 2/2008 Schormair
2008/0054060 A1 3/2008 Greenfield
2008/0116085 A1 5/2008 Artis et al.
2008/0179204 A1 7/2008 Lutzig
2008/0223912 A1 9/2008 Ayats Ardite et al.
2008/0237326 A1 10/2008 Bates
2008/0305209 A1 12/2008 Mattei
2009/0084787 A1 4/2009 Ikenoya
2009/0184158 A1 7/2009 Lutzig et al.
2009/0211941 A1 8/2009 Maroofian et al.
2009/0250370 A1 10/2009 Whitchurch
2009/0283581 A1 11/2009 Aldridge et al.
2010/0126895 A1 5/2010 Smith et al.
2010/0155402 A1 6/2010 Maroofian et al.
2010/0187150 A1 7/2010 Dijkstra et al.
2010/0307933 A1 12/2010 Nicholas
2010/0310731 A1 12/2010 Manning et al.
2010/0314284 A1 12/2010 Truesdale
2011/0132791 A1 6/2011 Dijkstra et al.
2011/0143070 A1 6/2011 Toft et al.
2011/0186461 A1 8/2011 Poitevin
2011/0294638 A1 12/2011 Tosevski
2012/0018502 A1 1/2012 Walling et al.
2012/0024940 A1 2/2012 Lakakis
2012/0048758 A1 3/2012 Arnold
2012/0091021 A1 4/2012 Smalley
2012/0091149 A1 4/2012 Pedmo
2012/0125796 A1 5/2012 Falcon
2012/0152783 A1 6/2012 Cheema et al.
2012/0152784 A1 6/2012 Nukuto et al.
2012/0199640 A1 8/2012 Thorne et al.
2012/0228370 A1 9/2012 Faulon et al.
2012/0247995 A1 10/2012 Charles

(56) References Cited

U.S. PATENT DOCUMENTS

2012/0280026 A1 11/2012 Faulon et al.
2012/0292328 A1 11/2012 Orgeldinger et al.
2012/0294988 A1 11/2012 Munro et al.
2013/0001120 A1 1/2013 Yaron et al.
2013/0074401 A1 3/2013 Forno
2013/0126524 A1 5/2013 Ueda et al.
2013/0139700 A1 6/2013 Fabozzi et al.
2013/0189393 A1 7/2013 Traldi
2013/0200100 A1 8/2013 Hanssen et al.
2013/0202750 A1 8/2013 Radley et al.
2013/0213855 A1 8/2013 Orgeldinger et al.
2013/0277418 A1 10/2013 Van Berlo et al.
2013/0291612 A1 11/2013 Dick et al.
2013/0319886 A1 12/2013 Ledermann
2013/0320006 A1 12/2013 Orgeldinger
2013/0327821 A1 12/2013 Zwaga et al.
2014/0144974 A1 5/2014 Boots et al.
2014/0170348 A1 6/2014 Yamazaki et al.
2014/0175025 A1 6/2014 Parker
2014/0230371 A1 8/2014 Taylor et al.
2014/0237897 A1 8/2014 Lotvak et al.
2014/0242230 A1 8/2014 Iwegbu
2014/0252008 A1 9/2014 Deleon
2014/0252011 A1 9/2014 Dunwoody
2014/0253718 A1 9/2014 Leitzen et al.
2014/0262871 A1 9/2014 Fath
2014/0262895 A1 9/2014 Maceira
2014/0263372 A1 9/2014 Brewer et al.
2014/0274552 A1 9/2014 Frink et al.
2014/0291180 A1 10/2014 Lutzig
2014/0305935 A1 10/2014 Decraim
2014/0312106 A1 10/2014 Jang
2014/0314916 A1 10/2014 Anderie et al.
2014/0353307 A1 12/2014 Pinkstone
2014/0356489 A1 12/2014 Pohl
2015/0004551 A1 1/2015 Ruehl
2015/0014201 A1 1/2015 Moore
2015/0014405 A1 1/2015 Robertson et al.
2015/0020364 A1 1/2015 Bonfoey
2015/0021317 A1 1/2015 Sharkey et al.
2015/0024094 A1 1/2015 Keller et al.
2015/0027917 A1 1/2015 Goddard
2015/0028045 A1 1/2015 Oakes
2015/0034707 A1 2/2015 Mello et al.
2015/0034709 A1 2/2015 Spivey, Sr. et al.
2015/0045551 A1 2/2015 Yoshinaga et al.
2015/0056339 A1 2/2015 Vaes
2015/0083642 A1 3/2015 Dellimore et al.
2015/0096644 A1 4/2015 Lee et al.
2015/0096921 A1 4/2015 Hyatt
2015/0096978 A1 4/2015 Henderson et al.
2015/0101380 A1 4/2015 Cook
2015/0108153 A1 4/2015 Faber
2015/0108208 A1 4/2015 Nash et al.
2015/0113921 A1 4/2015 Billings
2015/0115024 A1 4/2015 Finol et al.
2015/0122676 A1 5/2015 Brugger et al.
2015/0128529 A1 5/2015 Lopez-Arostegui Saenz
2015/0136764 A1 5/2015 Dropsy et al.
2015/0136796 A1 5/2015 Muehlhauser
2015/0144688 A1 5/2015 Bates et al.
2015/0151350 A1 6/2015 Carstens et al.
2015/0166215 A1 6/2015 Dirico
2015/0166257 A1 6/2015 Trombetta
2015/0191287 A1 7/2015 L'Heureux et al.
2015/0197386 A1 7/2015 Chang
2015/0203239 A1 7/2015 Iwegbu
2015/0210461 A1 7/2015 Morris et al.
2015/0225107 A1 8/2015 Ross et al.
2015/0225158 A1 8/2015 Lyzenga et al.
2015/0257407 A1 9/2015 Glazier et al.
2015/0259093 A1 9/2015 Boersma et al.
2015/0259109 A1 9/2015 Vetten et al.
2015/0274409 A1 10/2015 Nachbagauer et al.
2015/0283597 A1 10/2015 Monro
2015/0284134 A1 10/2015 Kreutzer et al.
2015/0284138 A1 10/2015 Lane et al.
2015/0284158 A1 10/2015 Yako
2015/0284165 A1 10/2015 Oeyen
2015/0298852 A1 10/2015 Higareda et al.
2015/0298884 A1 10/2015 Zhao et al.
2015/0313388 A1 11/2015 Kane
2015/0321832 A1 11/2015 Bankowski
2015/0329277 A1 11/2015 Dijkstra
2015/0343221 A1 12/2015 Mashiach
2015/0360820 A1 12/2015 Akutsu et al.
2015/0366386 A1 12/2015 D'Amato
2015/0367614 A1 12/2015 Sasaki et al.
2015/0368031 A1 12/2015 Wetton et al.
2015/0374178 A1 12/2015 Porte
2015/0375484 A1 12/2015 Johansson
2015/0375925 A1 12/2015 Wetton et al.
2016/0001948 A1 1/2016 Collins et al.
2016/0007807 A1 1/2016 D'Amato
2016/0009444 A1 1/2016 Nakagawa et al.
2016/0009446 A1 1/2016 Huizingh et al.
2016/0010172 A1 1/2016 Holleck et al.
2016/0016223 A1 1/2016 Wilkinson et al.
2016/0016685 A1 1/2016 Bauernfeind
2016/0016687 A1 1/2016 Ramsey et al.
2016/0023823 A1 1/2016 Barron
2016/0031634 A1 2/2016 Hodges et al.
2016/0038992 A1 2/2016 Arthur et al.
2016/0039600 A1 2/2016 Wilcox et al.
2016/0067644 A1 3/2016 Scaife
2016/0068313 A1 3/2016 Hart
2016/0075466 A1 3/2016 Wiley
2016/0075468 A1 3/2016 Kobayashi et al.
2016/0083166 A1 3/2016 Heyn
2016/0089829 A1 3/2016 Derkman et al.
2016/0090230 A1 3/2016 Dong
2016/0102414 A1 4/2016 Tani et al.
2016/0106248 A1 4/2016 Petersen et al.
2016/0107772 A1 4/2016 Eto et al.
2016/0114913 A1 4/2016 Eto et al.
2016/0122107 A1 5/2016 Pansegrouw
2016/0130060 A1 5/2016 Ball
2016/0130074 A1 5/2016 Kastha et al.
2016/0137330 A1 5/2016 Sobiech
2016/0137350 A1 5/2016 Hoekstra et al.
2016/0145462 A1 5/2016 Kawamura et al.
2016/0152394 A1 6/2016 Ghini et al.
2016/0152395 A1 6/2016 Pansegrouw
2016/0152406 A1 6/2016 Lloyd et al.
2016/0159544 A1 6/2016 Ghini et al.
2016/0167828 A1 6/2016 Ghini et al.
2016/0176554 A1 6/2016 Blake et al.
2016/0176570 A1 6/2016 Collier et al.
2016/0176571 A1 6/2016 Ruge
2016/0176617 A1 6/2016 Bolognia et al.
2016/0176621 A1 6/2016 Sytsma
2016/0193647 A1 7/2016 Holstine et al.
2016/0193800 A1 7/2016 Skinner
2016/0195118 A1 7/2016 Munch-Fals et al.
2016/0198892 A1 7/2016 Montagut Sala et al.
2016/0200485 A1 7/2016 Quinones et al.
2016/0214779 A1 7/2016 Riva
2016/0215801 A1 7/2016 Munch-Fals
2016/0221064 A1 8/2016 Namekawa et al.
2016/0221708 A1 8/2016 Ojima et al.
2016/0251105 A1 9/2016 Robinson et al.
2016/0256910 A1 9/2016 Niec et al.
2016/0257486 A1 9/2016 Kuiper et al.
2016/0264331 A1 9/2016 Gatteschi
2016/0272408 A1 9/2016 Knudsen
2016/0288947 A1 10/2016 Giraud et al.
2016/0302626 A1 10/2016 D'Hiet et al.
2016/0311578 A1 10/2016 Ramsuer
2016/0315037 A1 10/2016 Kadoguchi et al.
2016/0318217 A1 11/2016 Borghi et al.
2016/0318649 A1 11/2016 Bundy et al.
2016/0325471 A1 11/2016 Martini et al.
2016/0325533 A1 11/2016 Scharfenort et al.
2016/0325872 A1 11/2016 Barbieri et al.

(56) References Cited

U.S. PATENT DOCUMENTS

| | | | |
|---|---|---|---|
| 2016/0325878 | A1 | 11/2016 | Bjork et al. |
| 2016/0325879 | A1 | 11/2016 | Martini et al. |
| 2016/0325913 | A1 | 11/2016 | Kim et al. |
| 2016/0325919 | A1 | 11/2016 | Dijkstra |
| 2016/0331174 | A1 | 11/2016 | Allemand et al. |
| 2016/0332795 | A1 | 11/2016 | Mainz |
| 2016/0339537 | A1 | 11/2016 | Wu et al. |
| 2016/0340073 | A1 | 11/2016 | Babington |
| 2016/0340099 | A1 | 11/2016 | Scharfenort et al. |
| 2016/0347497 | A1 | 12/2016 | Novotny et al. |
| 2016/0355312 | A1 | 12/2016 | Paternina Leon et al. |
| 2016/0355320 | A1 | 12/2016 | Maier-Eschenlohr et al. |
| 2016/0355647 | A1 | 12/2016 | Ueda et al. |
| 2016/0361750 | A1 | 12/2016 | Lee |
| 2016/0367714 | A1 | 12/2016 | Fileccia et al. |
| 2016/0368701 | A1 | 12/2016 | Stoll et al. |
| 2017/0001230 | A1 | 1/2017 | Berrux et al. |
| 2017/0001786 | A1 | 1/2017 | Wallace |
| 2017/0002227 | A1 | 1/2017 | Gibanel et al. |
| 2017/0008207 | A1 | 1/2017 | Tamarindo |
| 2017/0015462 | A1 | 1/2017 | Roth et al. |
| 2017/0015480 | A1 | 1/2017 | Slack et al. |
| 2017/0028665 | A1 | 2/2017 | Ferreira Da Rocha et al. |
| 2017/0036846 | A1 | 2/2017 | Bressan et al. |
| 2017/0043901 | A1 | 2/2017 | Ogawa et al. |
| 2017/0043911 | A1 | 2/2017 | Kinouchi et al. |
| 2017/0057688 | A1 | 3/2017 | Patwardhan et al. |
| 2017/0057721 | A1 | 3/2017 | Lee et al. |
| 2017/0066579 | A1 | 3/2017 | Zillges |
| 2017/0087810 | A1 | 3/2017 | Schuman et al. |
| 2017/0105707 | A1 | 4/2017 | Senior et al. |
| 2017/0129653 | A1 | 5/2017 | Poitevin |
| 2017/0217651 | A2 | 8/2017 | Stirn |
| 2017/0361972 | A1 | 12/2017 | Herman et al. |
| 2017/0368593 | A1 | 12/2017 | Frishman |
| 2018/0002095 | A1 | 1/2018 | Mcdonald et al. |
| 2018/0079585 | A1 | 3/2018 | Berthault |
| 2018/0177208 | A1 | 6/2018 | Vaccarella et al. |
| 2018/0201431 | A1 | 7/2018 | Vincent |

FOREIGN PATENT DOCUMENTS

| | | | |
|---|---|---|---|
| AU | 726355 | B2 | 11/1997 |
| AU | 745584 | B2 | 5/1998 |
| AU | 729565 | B2 | 5/1999 |
| AU | 737716 | B2 | 2/2000 |
| AU | 763517 | B2 | 2/2000 |
| AU | 760345 | B2 | 7/2000 |
| AU | 200013569 | A1 | 8/2000 |
| AU | 777628 | B2 | 9/2000 |
| AU | 737840 | B1 | 8/2001 |
| AU | 770132 | B2 | 1/2002 |
| AU | 769925 | C | 2/2002 |
| AU | 2001279962 | B2 | 3/2002 |
| AU | 2001295245 | B2 | 4/2002 |
| AU | 782121 | B2 | 5/2002 |
| AU | 2001255628 | B2 | 11/2002 |
| AU | 756446 | B1 | 1/2003 |
| AU | 2002301632 | B2 | 6/2003 |
| AU | 2002351876 | B2 | 7/2003 |
| AU | 785244 | B2 | 10/2003 |
| AU | 2003218219 | B2 | 10/2003 |
| AU | 2003227159 | B1 | 5/2004 |
| AU | 2004203521 | B2 | 8/2004 |
| AU | 2004200559 | B2 | 9/2004 |
| AU | 2004228356 | B2 | 10/2004 |
| AU | 2004218733 | B2 | 11/2004 |
| AU | 2004222799 | B2 | 11/2004 |
| AU | 2004238398 | B2 | 11/2004 |
| AU | 2004277288 | B2 | 4/2005 |
| AU | 2004235603 | B2 | 6/2005 |
| AU | 2005200235 | B2 | 8/2005 |
| AU | 2005202709 | B2 | 2/2006 |
| AU | 2005237170 | B2 | 6/2006 |
| AU | 2005237171 | B2 | 6/2006 |
| AU | 2006258730 | B2 | 12/2006 |
| AU | 2006268011 | B2 | 1/2007 |
| AU | 2006273776 | B2 | 2/2007 |
| AU | 2006235890 | B2 | 5/2007 |
| AU | 2007203600 | C1 | 8/2007 |
| AU | 2007200952 | B2 | 9/2007 |
| AU | 2007214384 | B2 | 9/2007 |
| AU | 2007201523 | B2 | 10/2007 |
| AU | 2007221738 | B2 | 10/2007 |
| AU | 2007203066 | B2 | 1/2008 |
| AU | 2007343169 | B2 | 7/2008 |
| AU | 2008100779 | A4 | 10/2008 |
| AU | 2008252897 | B2 | 11/2008 |
| AU | 2008221543 | B2 | 3/2009 |
| AU | 2009100102 | A4 | 3/2009 |
| AU | 2009100414 | A4 | 7/2009 |
| AU | 2009100715 | A4 | 8/2009 |
| AU | 2009100873 | A4 | 10/2009 |
| AU | 2009101143 | A4 | 12/2009 |
| AU | 2009101204 | A4 | 12/2009 |
| AU | 2009300103 | B2 | 4/2010 |
| AU | 2010100275 | A4 | 4/2010 |
| AU | 2009322088 | B2 | 6/2010 |
| AU | 2010100414 | B4 | 6/2010 |
| AU | 2009341464 | B2 | 9/2010 |
| AU | 2010200687 | A1 | 9/2010 |
| AU | 2010101444 | A4 | 2/2011 |
| AU | 201100699 | A4 | 7/2011 |
| AU | 2011100749 | A4 | 8/2011 |
| AU | 2011204938 | B2 | 8/2011 |
| AU | 2010202016 | A1 | 12/2011 |
| AU | 2011101312 | A4 | 12/2011 |
| AU | 2011203304 | A1 | 2/2012 |
| AU | 2012100016 | A4 | 2/2012 |
| AU | 2011304564 | B2 | 3/2012 |
| AU | 2012100058 | A4 | 3/2012 |
| AU | 2012100081 | A4 | 3/2012 |
| AU | 2012100248 | A4 | 4/2012 |
| AU | 2012101088 | A4 | 8/2012 |
| AU | 2012200793 | A1 | 8/2012 |
| AU | 2012225203 | B2 | 9/2012 |
| AU | 2012201957 | A1 | 11/2012 |
| AU | 2012258335 | B2 | 12/2012 |
| AU | 2011203201 | A1 | 1/2013 |
| AU | 2011203534 | A1 | 1/2013 |
| AU | 2012203518 | A1 | 1/2013 |
| AU | 2011204892 | A1 | 2/2013 |
| AU | 2012211400 | A1 | 2/2013 |
| AU | 2013201952 | A1 | 4/2013 |
| AU | 2013205527 | A1 | 5/2013 |
| AU | 2012101891 | A4 | 6/2013 |
| AU | 2013100619 | B4 | 6/2013 |
| AU | 2013200014 | A1 | 7/2013 |
| AU | 2013101114 | A4 | 9/2013 |
| AU | 2013101227 | A4 | 10/2013 |
| AU | 2013205013 | A1 | 10/2013 |
| AU | 2013101358 | A4 | 11/2013 |
| AU | 2013204167 | A1 | 11/2013 |
| AU | 2013206121 | A1 | 12/2013 |
| AU | 2013260704 | B2 | 12/2013 |
| AU | 2012203731 | A1 | 1/2014 |
| AU | 2013294680 | B2 | 1/2014 |
| AU | 2014100103 | A4 | 3/2014 |
| AU | 2014100174 | A4 | 3/2014 |
| AU | 2014100439 | A4 | 6/2014 |
| AU | 2014202566 | A1 | 6/2014 |
| AU | 2013200123 | B2 | 7/2014 |
| AU | 2013202178 | A1 | 8/2014 |
| AU | 2014208248 | A1 | 8/2014 |
| AU | 2014250720 | A1 | 10/2014 |
| AU | 2013206023 | A1 | 12/2014 |
| AU | 2014224086 | A1 | 3/2015 |
| AU | 2015100511 | A4 | 5/2015 |
| AU | 2015101026 | A4 | 9/2015 |
| AU | 2015201241 | A1 | 10/2015 |
| BE | 700309 | A | 12/1967 |
| CA | 68833 | A | 9/1900 |
| CA | 73012 | A | 9/1901 |
| CA | 74071 | A | 12/1901 |

(56) References Cited

FOREIGN PATENT DOCUMENTS

| | | | |
|---|---|---|---|
| CA | 80184 | A | 4/1903 |
| CA | 92546 | A | 4/1905 |
| CA | 106704 | A | 7/1907 |
| CA | 106705 | A | 7/1907 |
| CA | 107756 | A | 10/1907 |
| CA | 119009 | A | 6/1909 |
| CA | 232843 | A | 7/1923 |
| CA | 2283774 | A1 | 9/1999 |
| CA | 2370696 | A1 | 10/2001 |
| CA | 2373094 | A1 | 11/2001 |
| CA | 2374569 | A1 | 12/2001 |
| CA | 2209287 | C | 7/2002 |
| CA | 2420078 | A1 | 2/2003 |
| CA | 101348 | | 1/2004 |
| CA | 2944101 | A1 | 12/2008 |
| CA | 2795773 | A1 | 6/2013 |
| CN | 2185250 | Y | 12/1994 |
| CN | 1931680 | A | 3/2007 |
| CN | 201334201 | Y | 10/2009 |
| CN | 201424243 | Y | 3/2010 |
| CN | 201520492 | U | 7/2010 |
| CN | 201745946 | U | 2/2011 |
| CN | 203359069 | U | 12/2013 |
| DE | 7629299 | U1 | 2/1977 |
| DE | 4324070 | A1 | 2/1994 |
| DE | 20001480 | U1 | 7/2000 |
| DE | 69925190 | T2 | 10/2005 |
| DE | 202005020050 | U1 | 4/2006 |
| EM | 000155480003 | A1 | 6/2004 |
| EM | 0001551480001 | A1 | 6/2004 |
| EM | 0001551480002 | A1 | 6/2004 |
| EM | 0001551480005 | A1 | 6/2004 |
| EM | 0001551480006 | A1 | 6/2004 |
| EM | 0002517230001 | A1 | 2/2005 |
| EM | 0002776030001 | A1 | 3/2005 |
| EM | 0002776030008 | A1 | 3/2005 |
| EM | 0003059740001 | A1 | 5/2005 |
| EM | 0003059740002 | A1 | 5/2005 |
| EM | 0003276630002 | A1 | 6/2005 |
| EM | 0003276630004 | A1 | 6/2005 |
| EM | 0003276630005 | A1 | 6/2005 |
| EM | 0002554680010 | A1 | 12/2005 |
| EM | 0006135340001 | A1 | 11/2006 |
| EM | 0006135340002 | A1 | 11/2006 |
| EM | 0006135340003 | A1 | 11/2006 |
| EM | 0006135340005 | A1 | 11/2006 |
| EM | 0006135340006 | A1 | 11/2006 |
| EM | 0006135340007 | A1 | 11/2006 |
| EM | 0006467400001 | A1 | 1/2007 |
| EM | 0006467400002 | A1 | 1/2007 |
| EM | 0006672900001 | A1 | 2/2007 |
| EM | 0007113460001 | A1 | 6/2007 |
| EM | 0007113460002 | A1 | 6/2007 |
| EM | 0007113460003 | A1 | 6/2007 |
| EM | 0007113460004 | A1 | 6/2007 |
| EM | 0007113460005 | A1 | 6/2007 |
| EM | 0007113460006 | A1 | 6/2007 |
| EM | 0007113460007 | A1 | 6/2007 |
| EM | 0007113460008 | A1 | 6/2007 |
| EM | 0007113460009 | A1 | 6/2007 |
| EM | 0007113460010 | A1 | 6/2007 |
| EM | 0007213780001 | A1 | 6/2007 |
| EM | 0007215430001 | A1 | 7/2007 |
| EM | 0007489180001 | A1 | 7/2007 |
| EM | 0007556810002 | A1 | 7/2007 |
| EM | 0007677280001 | A1 | 8/2007 |
| EM | 0007840040001 | A1 | 9/2007 |
| EM | 0008051220001 | A1 | 10/2007 |
| EM | 0008051220003 | A1 | 10/2007 |
| EM | 0007855220001 | A1 | 11/2007 |
| EM | 0008631960001 | A1 | 2/2008 |
| EM | 0007988300004 | A1 | 3/2008 |
| EM | 0009128600001 | A1 | 5/2008 |
| EM | 0009820200004 | A1 | 8/2008 |
| EM | 0009857340010 | A1 | 8/2008 |
| EM | 0009857340014 | A1 | 8/2008 |
| EM | 0009857340015 | A1 | 8/2008 |
| EM | 0007988300017 | A1 | 10/2008 |
| EM | 0010785880002 | A1 | 2/2009 |
| EM | 0010785880003 | A1 | 2/2009 |
| EM | 008387270001 | A1 | 3/2009 |
| EM | 0010551070001 | A1 | 3/2009 |
| EM | 0010618730001 | A1 | 3/2009 |
| EM | 0010618730002 | A1 | 3/2009 |
| EM | 0010822910001 | A1 | 3/2009 |
| EM | 0011301570011 | A1 | 7/2009 |
| EM | 0011301570012 | A1 | 7/2009 |
| EM | 0015914620001 | A1 | 8/2009 |
| EM | 001193970006 | A1 | 9/2009 |
| EM | 001493970005 | A1 | 9/2009 |
| EM | 0011493890001 | A1 | 9/2009 |
| EM | 0011493890002 | A1 | 9/2009 |
| EM | 0011493890003 | A1 | 9/2009 |
| EM | 0011493890004 | A1 | 9/2009 |
| EM | 0011493890006 | A1 | 9/2009 |
| EM | 0011493890007 | A1 | 9/2009 |
| EM | 0011493890008 | A1 | 9/2009 |
| EM | 0011493890009 | A1 | 9/2009 |
| EM | 0011493970001 | A1 | 9/2009 |
| EM | 0011493970002 | A1 | 9/2009 |
| EM | 0011493970003 | A1 | 9/2009 |
| EM | 0011493970004 | A1 | 9/2009 |
| EM | 0011494050001 | A1 | 9/2009 |
| EM | 0011494050002 | A1 | 9/2009 |
| EM | 0011494050003 | A1 | 9/2009 |
| EM | 0011637110001 | A1 | 11/2009 |
| EM | 0016347340002 | A1 | 11/2009 |
| EM | 0016426610003 | A1 | 12/2009 |
| EM | 0011862410001 | A1 | 1/2010 |
| EM | 0011862410002 | A1 | 1/2010 |
| EM | 0011862330001 | A1 | 2/2010 |
| EM | 0011862330002 | A1 | 2/2010 |
| EM | 0011874050001 | A1 | 2/2010 |
| EM | 0016759920001 | A1 | 3/2010 |
| EM | 0016811310001 | A1 | 4/2010 |
| EM | 0017150950002 | A1 | 6/2010 |
| EM | 0016904470001 | A1 | 8/2010 |
| EM | 0016904470002 | A1 | 8/2010 |
| EM | 0017387580002 | A1 | 9/2010 |
| EM | 0017490290001 | A1 | 9/2010 |
| EM | 0017683180001 | A1 | 10/2010 |
| EM | 001897360003 | A1 | 12/2010 |
| EM | 0017897360001 | A1 | 12/2010 |
| EM | 0017897360002 | A1 | 12/2010 |
| EM | 0017981330001 | A1 | 1/2011 |
| EM | 0017981330002 | A1 | 1/2011 |
| EM | 0018336250001 | A1 | 3/2011 |
| EM | 0018229090003 | A1 | 4/2011 |
| EM | 0018372790002 | A1 | 5/2011 |
| EM | 0018527240001 | A1 | 5/2011 |
| EM | 0018527240002 | A1 | 5/2011 |
| EM | 0018876210002 | A1 | 7/2011 |
| EM | 0018876210003 | A1 | 7/2011 |
| EM | 0011169410001 | A1 | 10/2011 |
| EM | 001963216008 | A1 | 1/2012 |
| EM | 0019631250001 | A1 | 1/2012 |
| EM | 0019631250002 | A1 | 1/2012 |
| EM | 0019631250003 | A1 | 1/2012 |
| EM | 0019631250004 | A1 | 1/2012 |
| EM | 0019631250005 | A1 | 1/2012 |
| EM | 0019631250006 | A1 | 1/2012 |
| EM | 0019631250007 | A1 | 1/2012 |
| EM | 0019631250008 | A1 | 1/2012 |
| EM | 0019631900001 | A1 | 1/2012 |
| EM | 0019631900002 | A1 | 1/2012 |
| EM | 0019631900003 | A1 | 1/2012 |
| EM | 0019631900004 | A1 | 1/2012 |
| EM | 0019631900005 | A1 | 1/2012 |
| EM | 0019631900006 | A1 | 1/2012 |
| EM | 0019631900007 | A1 | 1/2012 |
| EM | 0019631900008 | A1 | 1/2012 |
| EM | 0019632160001 | A1 | 1/2012 |
| EM | 0019632160002 | A1 | 1/2012 |
| EM | 0019632160003 | A1 | 1/2012 |

(56) References Cited

FOREIGN PATENT DOCUMENTS

| | | | |
|---|---|---|---|
| EM | 0019632160004 | A1 | 1/2012 |
| EM | 0019632160005 | A1 | 1/2012 |
| EM | 0019632160006 | A1 | 1/2012 |
| EM | 0019632160007 | A1 | 1/2012 |
| EM | 0013118150001 | A1 | 2/2012 |
| EM | 0013118150003 | A1 | 2/2012 |
| EM | 0013118150004 | A1 | 2/2012 |
| EM | 0013118150005 | A1 | 2/2012 |
| EM | 0020095300001 | A1 | 3/2012 |
| EM | 0020406590001 | A1 | 10/2012 |
| EM | 0020406590002 | A1 | 10/2012 |
| EM | 0020406590003 | A1 | 10/2012 |
| EM | 0021864030001 | A1 | 2/2013 |
| EM | 0021864030002 | A1 | 2/2013 |
| EM | 0021864030004 | A1 | 2/2013 |
| EM | 0021864030005 | A1 | 2/2013 |
| EM | 0021864030006 | A1 | 2/2013 |
| EM | 0022203430001 | A1 | 7/2013 |
| EM | 0022203430002 | A1 | 7/2013 |
| EM | 0022203430003 | A1 | 7/2013 |
| EM | 0022203430004 | A1 | 7/2013 |
| EM | 0022203430009 | A1 | 7/2013 |
| EM | 0022203430010 | A1 | 7/2013 |
| EM | 0022203430011 | A1 | 7/2013 |
| EM | 0022203430012 | A1 | 7/2013 |
| EM | 0022203430013 | A1 | 7/2013 |
| EM | 0022203430014 | A1 | 7/2013 |
| EM | 0022203430015 | A1 | 7/2013 |
| EM | 0022203430016 | A1 | 7/2013 |
| EM | 0022203430017 | A1 | 7/2013 |
| EM | 0022857180001 | A1 | 8/2013 |
| EM | 0022857180003 | A1 | 8/2013 |
| EM | 0022857180005 | A1 | 8/2013 |
| EM | 0022857180007 | A1 | 8/2013 |
| EM | 0022857180009 | A1 | 8/2013 |
| EM | 002307124001 | A1 | 11/2013 |
| EM | 0023071240002 | A1 | 11/2013 |
| EM | 0023071240003 | A1 | 11/2013 |
| EM | 0023071240004 | A1 | 11/2013 |
| EM | 0023071240005 | A1 | 11/2013 |
| EM | 0018936600002 | A1 | 1/2014 |
| EM | 0014042480001 | A1 | 3/2014 |
| EM | 0014042480002 | A1 | 3/2014 |
| EM | 0014042480003 | A1 | 3/2014 |
| EM | 0014042480004 | A1 | 3/2014 |
| EM | 0014042480005 | A1 | 3/2014 |
| EM | 0014042480006 | A1 | 3/2014 |
| EM | 0014042480007 | A1 | 3/2014 |
| EM | 0023738030001 | A1 | 3/2014 |
| EM | 0023738030002 | A1 | 3/2014 |
| EM | 0023738030003 | A1 | 3/2014 |
| EM | 0023738030004 | A1 | 3/2014 |
| EM | 0024362530001 | A1 | 5/2014 |
| EM | 0024362530002 | A1 | 5/2014 |
| EM | 0024362530003 | A1 | 5/2014 |
| EM | 0024691300001 | A1 | 5/2014 |
| EM | 0024900600001 | A1 | 8/2014 |
| EM | 0025014780001 | A1 | 10/2014 |
| EM | 0025014780002 | A1 | 10/2014 |
| EM | 0025014780003 | A1 | 10/2014 |
| EM | 0025014780004 | A1 | 10/2014 |
| EM | 0025014780005 | A1 | 10/2014 |
| EM | 0026280080001 | A1 | 2/2015 |
| EM | 0026280080002 | A1 | 2/2015 |
| EM | 0026329840001 | A1 | 2/2015 |
| EM | 0026901560001 | A1 | 5/2015 |
| EM | 0027774090001 | A1 | 10/2015 |
| EM | 0028869290001 | A1 | 12/2015 |
| EM | 0028881560001 | A1 | 12/2015 |
| EM | 0028881560002 | A1 | 12/2015 |
| EM | 0028881560003 | A1 | 12/2015 |
| EM | 0028881560004 | A1 | 12/2015 |
| EM | 0028881560005 | A1 | 12/2015 |
| EM | 0028881560006 | A1 | 12/2015 |
| EM | 0028881560007 | A1 | 12/2015 |
| EM | 0028881560008 | A1 | 12/2015 |
| EM | 0028881560009 | A1 | 12/2015 |
| EM | 0028881560010 | A1 | 12/2015 |
| EM | 0028881560011 | A1 | 12/2015 |
| EM | 0028881560012 | A1 | 12/2015 |
| EM | 0028881560013 | A1 | 12/2015 |
| EM | 0028881560014 | A1 | 12/2015 |
| EM | 0028881560015 | A1 | 12/2015 |
| EM | 0028881560016 | A1 | 12/2015 |
| EM | 0028881560017 | A1 | 12/2015 |
| EM | 0028881560018 | A1 | 12/2015 |
| EM | 0028881560019 | A1 | 12/2015 |
| EM | 0028881560020 | A1 | 12/2015 |
| EM | 0028881560021 | A1 | 12/2015 |
| EM | 0028881560022 | A1 | 12/2015 |
| EM | 0028881560023 | A1 | 12/2015 |
| EM | 0028881560024 | A1 | 12/2015 |
| EM | 0030008350001 | A1 | 2/2016 |
| EM | 003225853001 | A1 | 7/2016 |
| EM | 0033059780001 | A1 | 9/2016 |
| EM | 0033059780002 | A1 | 9/2016 |
| EM | 0033059780003 | A1 | 9/2016 |
| EM | 0033734220001 | A1 | 9/2016 |
| EM | 0034434310001 | A1 | 11/2016 |
| EM | 0035011880004 | A1 | 12/2016 |
| EM | 0014521220001 | A1 | 1/2017 |
| EM | 0014521220002 | A1 | 1/2017 |
| EM | 0034514670001 | A1 | 1/2017 |
| EM | 0035285610001 | A1 | 1/2017 |
| EM | 0035285610002 | A1 | 1/2017 |
| EM | 003737740004 | A1 | 2/2017 |
| EM | 0034659620001 | A1 | 2/2017 |
| EM | 0035785900001 | A1 | 2/2017 |
| EM | 0037000460001 | A1 | 2/2017 |
| EM | 0037377410002 | A1 | 2/2017 |
| EM | 0037377410003 | A1 | 2/2017 |
| EM | 0037377410005 | A1 | 2/2017 |
| EM | 0037377410006 | A1 | 2/2017 |
| EM | 0037377410007 | A1 | 2/2017 |
| EM | 0037377410008 | A1 | 2/2017 |
| EP | 0368672 | A1 | 5/1990 |
| EP | 0530344 | A1 | 3/1993 |
| EP | 0768039 | A1 | 4/1997 |
| EP | 0919488 | A1 | 6/1999 |
| EP | 1002464 | A2 | 5/2000 |
| EP | 1533245 | A1 | 5/2005 |
| EP | 2476631 | A2 | 7/2012 |
| FR | 2291111 | A1 | 6/1976 |
| GB | 2010221 | A | 6/1979 |
| JP | H101180 | A | 1/1998 |
| JP | 2006137461 | A | 6/2006 |
| JP | 2006256649 | A | 9/2006 |
| JP | 20006256656 | A | 9/2006 |
| NZ | 272914 | A | 7/1997 |
| NZ | 280054 | A | 9/1997 |
| NZ | 299120 | A | 12/1997 |
| NZ | 330354 | A | 9/1998 |
| NZ | 330830 | | 1/2000 |
| NZ | 333185 | A | 2/2000 |
| NZ | 337406 | A | 6/2001 |
| NZ | 511904 | | 12/2002 |
| NZ | 506322 | | 1/2003 |
| NZ | 522201 | | 2/2003 |
| NZ | 505542 | | 3/2003 |
| NZ | 512955 | A | 8/2003 |
| NZ | 510085 | A | 10/2003 |
| NZ | 519573 | A | 11/2003 |
| NZ | 519160 | | 12/2003 |
| NZ | 519808 | | 1/2004 |
| NZ | 513752 | | 2/2004 |
| NZ | 531197 | A | 5/2004 |
| NZ | 515006 | A | 6/2004 |
| NZ | 532077 | A | 6/2004 |
| NZ | 521445 | A | 8/2004 |
| NZ | 518616 | A | 11/2004 |
| NZ | 523571 | A | 11/2004 |
| NZ | 539338 | A | 12/2005 |
| NZ | 525194 | A | 1/2006 |
| NZ | 530386 | A | 6/2006 |

(56) References Cited

FOREIGN PATENT DOCUMENTS

| | | | |
|---|---|---|---|
| NZ | 531751 | A | 7/2006 |
| NZ | 542387 | A | 9/2006 |
| NZ | 532815 | A | 1/2007 |
| NZ | 541132 | A | 5/2007 |
| NZ | 545998 | A | 8/2007 |
| NZ | 543525 | A | 6/2008 |
| NZ | 555516 | A | 7/2008 |
| NZ | 547917 | A | 10/2008 |
| NZ | 552423 | A | 12/2008 |
| NZ | 571924 | A | 3/2009 |
| NZ | 567591 | A | 6/2009 |
| NZ | 554833 | A | 7/2009 |
| NZ | 551190 | A | 9/2009 |
| NZ | 566916 | A | 12/2009 |
| NZ | 584464 | A | 7/2010 |
| NZ | 581480 | A | 3/2011 |
| NZ | 568751 | A | 5/2011 |
| NZ | 577975 | A | 7/2011 |
| NZ | 569896 | A | 8/2011 |
| NZ | 571742 | A | 8/2011 |
| NZ | 582203 | A | 9/2011 |
| NZ | 582515 | A | 9/2011 |
| NZ | 582680 | A | 9/2011 |
| NZ | 575790 | A | 10/2011 |
| NZ | 575791 | A | 12/2011 |
| NZ | 581650 | A | 3/2012 |
| NZ | 578867 | A | 4/2012 |
| NZ | 577407 | A | 5/2012 |
| NZ | 581226 | A | 5/2012 |
| NZ | 579602 | A | 6/2012 |
| NZ | 597670 | | 6/2013 |
| NZ | 613350 | | 8/2013 |
| NZ | 592208 | | 10/2013 |
| NZ | 598786 | | 11/2013 |
| NZ | 609447 | | 11/2013 |
| NZ | 617276 | | 1/2014 |
| NZ | 607063 | | 4/2014 |
| NZ | 704570 | | 8/2015 |
| NZ | 710886 | | 8/2015 |
| NZ | 705874 | | 9/2015 |
| NZ | 704860 | | 10/2015 |
| NZ | 628779 | | 11/2015 |
| NZ | 706489 | | 2/2016 |
| NZ | 711550 | | 3/2016 |
| NZ | 704856 | | 1/2019 |
| WO | 8702336 | A1 | 4/1987 |
| WO | 9302599 | A1 | 2/1993 |
| WO | 9404441 | A1 | 3/1994 |
| WO | D0476640001 | | 3/1999 |
| WO | D0488940004 | | 6/1999 |
| WO | D0503630006 | | 1/2000 |
| WO | 0073157 | A1 | 12/2000 |
| WO | D0544850002 | | 12/2000 |
| WO | D0571810001 | | 9/2001 |
| WO | D0583030001 | | 12/2001 |
| WO | D0709990022 | | 11/2003 |
| WO | D0662250001 | | 12/2004 |
| WO | 2005047123 | A1 | 5/2005 |
| WO | D0709990005 | | 11/2008 |
| WO | D0709990007 | | 11/2008 |
| WO | 2009091998 | A1 | 7/2009 |
| WO | D0721030001 | | 7/2009 |
| WO | D0721030002 | | 7/2009 |
| WO | D0721030003 | | 7/2009 |
| WO | D0721030004 | | 7/2009 |
| WO | D0721030005 | | 7/2009 |
| WO | D0721030006 | | 7/2009 |
| WO | D0721030007 | | 7/2009 |
| WO | D0721030008 | | 7/2009 |
| WO | D0721030009 | | 7/2009 |
| WO | D0721030010 | | 7/2009 |
| WO | D0721030011 | | 7/2009 |
| WO | D0721030012 | | 7/2009 |
| WO | D0721030013 | | 7/2009 |
| WO | D0721030014 | | 7/2009 |
| WO | D0721030015 | | 7/2009 |
| WO | D0721030016 | | 7/2009 |
| WO | D0721030017 | | 7/2009 |
| WO | D0721030018 | | 7/2009 |
| WO | D0721030019 | | 7/2009 |
| WO | D0721030020 | | 7/2009 |
| WO | D0721030022 | | 7/2009 |
| WO | D0721030023 | | 7/2009 |
| WO | D07211030021 | | 7/2009 |
| WO | 2009104207 | A1 | 8/2009 |
| WO | 2010060120 | A3 | 5/2010 |
| WO | 2010066427 | A1 | 6/2010 |
| WO | 2010070500 | A3 | 6/2010 |
| WO | D0741310007 | | 8/2010 |
| WO | 2011001200 | A1 | 1/2011 |
| WO | 2011006943 | A1 | 1/2011 |
| WO | 2011097530 | A1 | 8/2011 |
| WO | 2011116957 | A1 | 9/2011 |
| WO | 2011120887 | A1 | 10/2011 |
| WO | 2011120888 | A1 | 10/2011 |
| WO | 2011120889 | A1 | 10/2011 |
| WO | 2011133851 | A2 | 10/2011 |
| WO | D0786150001 | | 11/2011 |
| WO | D0786150002 | | 11/2011 |
| WO | D0786150003 | | 11/2011 |
| WO | D0786150004 | | 11/2011 |
| WO | D0786150005 | | 11/2011 |
| WO | D0786150006 | | 11/2011 |
| WO | D0786150007 | | 11/2011 |
| WO | D0786150008 | | 11/2011 |
| WO | D0786150009 | | 11/2011 |
| WO | D0786150012 | | 11/2011 |
| WO | D0786150019 | | 11/2011 |
| WO | D0786150020 | | 11/2011 |
| WO | D0786150021 | | 11/2011 |
| WO | 2012019222 | A1 | 2/2012 |
| WO | 2012023072 | A2 | 2/2012 |
| WO | 2012025194 | A1 | 3/2012 |
| WO | 2012038228 | A1 | 3/2012 |
| WO | D0788860003 | | 7/2012 |
| WO | 2012119198 | A1 | 9/2012 |
| WO | D0792260001 | | 9/2012 |
| WO | 2012141986 | A1 | 10/2012 |
| WO | 2012156956 | A1 | 11/2012 |
| WO | 2013072869 | A1 | 5/2013 |
| WO | 2013075989 | A1 | 5/2013 |
| WO | D0809510005 | | 5/2013 |
| WO | D0809510007 | | 5/2013 |
| WO | D0809510008 | | 5/2013 |
| WO | 2013081810 | A1 | 6/2013 |
| WO | 2013093628 | A1 | 6/2013 |
| WO | 2013098544 | A1 | 7/2013 |
| WO | 2013123561 | A1 | 8/2013 |
| WO | 201138580 | A1 | 9/2013 |
| WO | 2013131126 | A1 | 9/2013 |
| WO | 2013134547 | A1 | 9/2013 |
| WO | 2013141769 | A1 | 9/2013 |
| WO | 2013144612 | A2 | 10/2013 |
| WO | 2013153530 | A1 | 10/2013 |
| WO | 2013173503 | A1 | 11/2013 |
| WO | 2013277072 | A1 | 11/2013 |
| WO | 2013181698 | A1 | 12/2013 |
| WO | D0825560007 | | 12/2013 |
| WO | D0825560008 | | 12/2013 |
| WO | D0825560009 | | 12/2013 |
| WO | 2014014349 | A1 | 1/2014 |
| WO | 2014052421 | A1 | 4/2014 |
| WO | D0842580001 | | 5/2014 |
| WO | D0842580002 | | 5/2014 |
| WO | D0842580003 | | 5/2014 |
| WO | D0842580004 | | 5/2014 |
| WO | D0842580005 | | 5/2014 |
| WO | D0842580006 | | 5/2014 |
| WO | D0842580007 | | 5/2014 |
| WO | 2014121865 | A1 | 8/2014 |
| WO | 2014122057 | A1 | 8/2014 |
| WO | 2014125878 | A1 | 8/2014 |
| WO | 2014127213 | A1 | 8/2014 |
| WO | 2014134591 | A1 | 9/2014 |

(56) References Cited

FOREIGN PATENT DOCUMENTS

| | | | |
|---|---|---|---|
| WO | 2014135594 | A1 | 9/2014 |
| WO | 2014136725 | A1 | 9/2014 |
| WO | 2014140394 | A1 | 9/2014 |
| WO | 2014141131 | A1 | 9/2014 |
| WO | 2014141839 | A1 | 9/2014 |
| WO | 2014142860 | A1 | 9/2014 |
| WO | 2014142893 | A1 | 9/2014 |
| WO | 2014146957 | A1 | 9/2014 |
| WO | 2014147421 | A1 | 9/2014 |
| WO | 2014147751 | A1 | 9/2014 |
| WO | 2014150125 | A2 | 9/2014 |
| WO | 2014150442 | A1 | 9/2014 |
| WO | 2014150834 | A1 | 9/2014 |
| WO | 2014155167 | A1 | 10/2014 |
| WO | 2014155315 | A1 | 10/2014 |
| WO | 2014155483 | A1 | 10/2014 |
| WO | 2014161055 | A1 | 10/2014 |
| WO | 2014161684 | A1 | 10/2014 |
| WO | 2014162689 | A1 | 10/2014 |
| WO | 2014170476 | A1 | 10/2014 |
| WO | 2014170651 | A1 | 10/2014 |
| WO | 2014171181 | A1 | 10/2014 |
| WO | 2014176292 | A1 | 10/2014 |
| WO | 2014179849 | A1 | 11/2014 |
| WO | 2014181752 | A1 | 11/2014 |
| WO | 2014186259 | A1 | 11/2014 |
| WO | 2014186725 | A1 | 11/2014 |
| WO | 2014187514 | A1 | 11/2014 |
| WO | 2014187741 | A1 | 11/2014 |
| WO | 2014188358 | A1 | 11/2014 |
| WO | 2014188394 | A1 | 11/2014 |
| WO | 2014188395 | A1 | 11/2014 |
| WO | 2014195008 | A2 | 12/2014 |
| WO | 2014198800 | A2 | 12/2014 |
| WO | 2014199245 | A1 | 12/2014 |
| WO | 2014199856 | A1 | 12/2014 |
| WO | 2014202927 | A1 | 12/2014 |
| WO | 2014206939 | A1 | 12/2014 |
| WO | 00854320017 | | 1/2015 |
| WO | 2015001343 | A1 | 1/2015 |
| WO | 2015001406 | A1 | 1/2015 |
| WO | 2015001598 | A1 | 1/2015 |
| WO | 2015004524 | A1 | 1/2015 |
| WO | 2015011186 | A1 | 1/2015 |
| WO | 2015012176 | A1 | 1/2015 |
| WO | D0854320001 | | 1/2015 |
| WO | D0854320015 | | 1/2015 |
| WO | D0854320016 | | 1/2015 |
| WO | D0854320018 | | 1/2015 |
| WO | D0854320019 | | 1/2015 |
| WO | D0854320020 | | 1/2015 |
| WO | D0854320021 | | 1/2015 |
| WO | 2015015333 | A1 | 2/2015 |
| WO | 2015019228 | A2 | 2/2015 |
| WO | 2015023207 | A1 | 2/2015 |
| WO | 2015023702 | A1 | 2/2015 |
| WO | 2015024084 | A1 | 2/2015 |
| WO | 2015026832 | A2 | 2/2015 |
| WO | 2015027292 | A1 | 3/2015 |
| WO | 2015027795 | A1 | 3/2015 |
| WO | 2015027857 | A1 | 3/2015 |
| WO | 2015028917 | A1 | 3/2015 |
| WO | 2015030747 | A1 | 3/2015 |
| WO | 2015031962 | A1 | 3/2015 |
| WO | 2015031964 | A1 | 3/2015 |
| WO | 2015032142 | A1 | 3/2015 |
| WO | 2015033164 | A1 | 3/2015 |
| WO | 2015038513 | A1 | 3/2015 |
| WO | 2015039462 | A1 | 3/2015 |
| WO | 2015039642 | A1 | 3/2015 |
| WO | 2015041323 | A1 | 3/2015 |
| WO | 2015045025 | A1 | 4/2015 |
| WO | 2015045049 | A1 | 4/2015 |
| WO | 2015045070 | A1 | 4/2015 |
| WO | 2015046145 | A1 | 4/2015 |
| WO | 2015049061 | A1 | 4/2015 |
| WO | 2015049692 | A1 | 4/2015 |
| WO | 2015049702 | A1 | 4/2015 |
| WO | 2015054442 | A1 | 4/2015 |
| WO | 2015058248 | A1 | 4/2015 |
| WO | 2015058934 | A1 | 4/2015 |
| WO | 2015059601 | A1 | 4/2015 |
| WO | 2015060073 | A1 | 4/2015 |
| WO | 2015060529 | A1 | 4/2015 |
| WO | 2015066109 | A1 | 5/2015 |
| WO | 2015066144 | A1 | 5/2015 |
| WO | 2015068236 | A1 | 5/2015 |
| WO | 2015069009 | A1 | 5/2015 |
| WO | 2015079363 | A1 | 6/2015 |
| WO | 2015079927 | A1 | 6/2015 |
| WO | 2015082876 | A1 | 6/2015 |
| WO | 2015084904 | A1 | 6/2015 |
| WO | 2015086298 | A1 | 6/2015 |
| WO | 2015086884 | A1 | 6/2015 |
| WO | 2015087158 | A2 | 6/2015 |
| WO | 2015096558 | A1 | 7/2015 |
| WO | 2015096559 | A1 | 7/2015 |
| WO | 2015097288 | A1 | 7/2015 |
| WO | 2015097604 | A1 | 7/2015 |
| WO | 2015097827 | A1 | 7/2015 |
| WO | 2015099813 | A1 | 7/2015 |
| WO | 2015101456 | A1 | 7/2015 |
| WO | 2015104612 | A1 | 7/2015 |
| WO | 2015106712 | A1 | 7/2015 |
| WO | 2015110914 | A1 | 7/2015 |
| WO | 2015115096 | A1 | 8/2015 |
| WO | 2015115533 | A1 | 8/2015 |
| WO | 2015116752 | A1 | 8/2015 |
| WO | 2015119021 | A1 | 8/2015 |
| WO | 2015121643 | A2 | 8/2015 |
| WO | 2015122066 | A1 | 8/2015 |
| WO | 2015124643 | A1 | 8/2015 |
| WO | 2015124830 | A1 | 8/2015 |
| WO | 2015125292 | A1 | 8/2015 |
| WO | 2015131295 | A1 | 9/2015 |
| WO | 2015137798 | A1 | 9/2015 |
| WO | 2015138656 | A1 | 9/2015 |
| WO | 2015139648 | A1 | 9/2015 |
| WO | 2014154281 | A1 | 10/2015 |
| WO | 2015147180 | A1 | 10/2015 |
| WO | 2015151100 | A1 | 10/2015 |
| WO | 2015154198 | A1 | 10/2015 |
| WO | 2015154281 | A1 | 10/2015 |
| WO | 2015160248 | A1 | 10/2015 |
| WO | 2015165009 | A1 | 11/2015 |
| WO | 2015165406 | A1 | 11/2015 |
| WO | 2015166341 | A1 | 11/2015 |
| WO | 2015168045 | A1 | 11/2015 |
| WO | 2015177683 | A1 | 11/2015 |
| WO | D0888940001 | | 11/2015 |
| WO | 2014203220 | A1 | 12/2015 |
| WO | 2016079663 | A1 | 5/2016 |
| WO | 2016120033 | A1 | 8/2016 |
| WO | D0941140001 | | 12/2016 |

OTHER PUBLICATIONS

ISR and Written Opinion PCT/GB2013/050790 dated Oct. 14, 2013.

First Office Action & Search Report; Chinese Appln. No. 201380017248.2; dated Jun. 18, 2015; 22 Pages.

Further Examination Report; New Zealand Application No. 629719; dated Jan. 8, 2016; 2 Pages.

Written Opinion of the International Searching Authority; International Application No. PCT/GB2014/050667; International Filing Date: Mar. 6, 2014; dated Sep. 29, 2014; 8 Pages.

Communication pursuant to Rule 164(2)(b) and Article 94(3) EPC; European Application No. 14710356.8; dated Nov. 30, 2016; 3 Pages.

Communication under Rule 164(2)(a) EPC; European Application No. 14710356.8; dated Oct. 28, 2016; 4 Pages.

First Examination Report; New Zealand Application No. 709425; dated Nov. 9, 2015; 5 Pages.

(56) References Cited

OTHER PUBLICATIONS

Further Search Report under Section 17; Great Britain Application No. 1304169.4; Date of Search: May 12, 2014; 2 Pages.
International Preliminary Report on Patentability; International Application No. PCT/GB2014/050665; International Filing Date: Mar. 6, 2014; dated Sep. 8, 2015; 9 Pages.
International Preliminary Report on Patentability; International Application No. PCT/GB2014/050667; International Filing Date: Mar. 6, 2014; dated Sep. 8, 2015; 9 Pages.
Non-Final Office Action; U.S. Appl. No. 14/765,116, filed Jul. 31, 2015; Improved Packaging and Method of Opening; Notification Date: Apr. 21, 2017; 19 Pages.
Non-Final Office Action; U.S. Appl. No. 14/765,116, filed Jul. 31, 2015; Improved Packaging and Method of Opening; Notification Date: Nov. 6, 2017; 9 Pages.
Non-Final Office Action; U.S. Appl. No. 14/765,137, filed Jul. 31, 2015; Improved Packaging and Method of Opening; Notification Date: Feb. 2, 2017; 24 Pages.
Notice of Allowance; U.S. Appl. No. 14/765,137, filed Jul. 31, 2015; Improved Packaging and Method of Opening; Notification Date: Sep. 27, 2017; 8 Pages.
Office Action and Examination Search Report; Canadian Application No. 2,900,899; dated Feb. 13, 2017; 3 Pages.
Patent Cooperation Treaty; International Search Report; PCT/GB2014/050665; International Filing Date: Mar. 6, 2014; 6 pages.
Patent Cooperation Treaty; International Search Report; PCT/GB2014/050667; International Filing Date: Mar. 6, 2014; 7 pages.
Restriction Requirement; U.S. Appl. No. 14/765,116, filed Jul. 31, 2015; Improved Packaging and Method of Opening; Notification Date: Jan. 30, 2017; 9 Pages.
Restriction Requirement; U.S. Appl. No. 14/765,137, filed Jul. 31, 2015; Improved Packaging and Method of Opening; Notification Date: Sep. 2, 2016; 9 Pages.
Search Report under Section 17; Great Britain Application No. 1304169.4; Date of Search: Aug. 8, 2013; 2 Pages.
Search Report; Great Britain Appln. No. 1304167.8; Date of Search: Aug. 9, 2013; 2 Pages.
Search Report; Great Britain Appln. No. 1304167.8; Date of Search: May 12, 2014; 2 Pages.
Second Search Report; Great Britain Appln. No. 1304167.8; Date of Search: May 12, 2014; 2 Pages.
Written Opinion of the International Searching Authority; International Application No. PCT/GB2014/050665; International Filing Date: Mar. 6, 2014; dated Sep. 29, 2014; 8 Pages.
Hague Registration Details; International Registration No. DM/027376; Publication Date: Nov. 30, 1993; 2 Pages.
Hague Registration Details; International Registration No. DM/028567; Publication Date: Mar. 31, 1994; 2 Pages.
Hague Registration Details; International Registration No. DM/035732; Publication Date: May 31, 1996; 3 Pages.
Hague Registration Details; International Registration No. DM/040299; Publication Date: Jul. 31, 1997; 11 Pages.
Hague Registration Details; International Registration No. DM/041549; Publication Date: Nov. 28, 1997; 4 Pages.
RCD File Information; European Union Design No. 000214796-0006: Registration Date: Aug. 13, 2004; 3 Pages.
RCD File Information; European Union Design No. 002502856-0001: Registration Date: Jul. 15, 2014; 4 Pages.
Case Details Report; New Zealand Patent No. 624638; Filing Date: May 7, 2014; 2 Pages.
Case Details Report; New Zealand Patent No. 628399; Filing Date: Aug. 7, 2014; 2 Pages.
Case Details Report; New Zealand Patent No. 712699; Filing Date: Aug. 7, 2014; 2 Pages.
Communication Pursuant to Article 94(3) EPC; European Application No. 14710354.3; dated Nov. 14, 2017; 7 Pages.
Communication Pursuant to Article 94(3) EPC; European Application No. 14710356.8; dated Sep. 27, 2017; 6 Pages.
Communication pursuant to Article 94(3) EPC; European Application No. 16166235.8; dated Sep. 25, 2017; 4 Pages.
Communication Pursuant to Article 94(3) EPC; European Application No. 17151673.5; dated Sep. 20, 2017; 7 Pages.
Examination Report; Great Britain Application No. 1304167.8; dated May 3, 2018; 1 Page.
Machine Translation from the EPO; Chinese Patent No. 2185250; dated Dec. 14, 1994; 4 Pages.
Notification of the First Office Action; Chinese Application No. 201480011314.X; dated May 17, 2016; 1 Page.
Notification of the First Office Action; Chinese Application No. 201610868211.6; dated May 23, 2018; 10 Pages.
Notification of the First Office Action; Chinese Application No. 201611099710.X; dated Jun. 19, 2018; 5 Pages.
Patens Act 1977 Examination Report under Section 18(3); Great Britain Application No. 1304167.8; dated Nov. 24, 2017; 1 Page.
Patents Act 1977: Examination Report under Section 18(3); Great Britain Application No. 1304167.8; dated Jul. 27, 2018; 9 Pages.
Patents Act 1977: Examination Report under Section 18(3); Great Britain Application No. 1304169.4; dated Nov. 30, 2017; 6 Pages.
Patents Act 1977: Examination Report under Section 18(3); Great Britain Application No. 1304169.4; dated May 3, 2018; 7 Pages.
ROG (2011) "I-Mockery's Ultimate Guide to the Halloween Candies of 2011"; URL Accessed: http://www.i-mockery.com/minimocks/halloween-candy2011/default; Date Accessed: Mar. 27,2018; 9 Pages.
Patents Act 1977: Examination Report under Section 18(3); Great Britain Application No. 1304169.4; dated Jul. 27, 2018: 8 Pages.

* cited by examiner

PACKAGING AND METHOD OF OPENING

FIELD

The disclosure relates to food packaging for confectionery or the like and in particular, although not exclusively, to packaging that conforms to the shape of the packaged product such as packaging for confectionery eggs.

BACKGROUND

Confectionery eggs are often wrapped in a foil wrapper that conforms to the shape of the packaged confectionery egg. Here a rectangular foil sheet with graphics and the like printed on the outer side is wrapped around a confectionery egg to provide a protective barrier and maintain the confectionery egg in a hygienic condition ready for consumption. The foil is easily malleable so forms a close contour around the confectionery egg so that the packaged confectionery egg substantially maintains its outer profile. Because the foil is wrapped around the confectionery egg, it is not possible to provide a continuous graphic on the packaged product. Furthermore, the appearance of the packaged product is not always repeated. That is, the graphics on the outer surface of the foil can form differently from one production line to the next and even between packaged confectionery eggs on the same production line.

In use, the foil wrapped confectionery eggs can be sold individually from containers in which loose filled confectionery eggs are stored. Typically, the confectionery eggs will be stacked randomly on top of each other given the non-stacking shape. Once purchased, a consumer unwraps the packaged confectionery egg from the foil wrapper to consume the confectionery egg. The foil wrapper is able to be unwrapped because the packaging process does not seal the edges of the foil. The consumer therefore simply peels back an edge of the foil wrapper to begin opening. This opening procedure does not provide for a tamper evident packaging. That is, because the foil wrapper can be reclosed to substantially its original position, it is not possible for a consumer to know if the packaging has been tampered with, following dispatch from the confectionery plant.

SUMMARY

The present disclosure attempts to overcome at least one of the above or other disadvantages. It is a further aim to provide a packaging and packaging method that may allow a packaging to conform to the shape of the packaged product whilst still providing a tamper evident closure and additionally or alternatively an improved graphical consistency on the outer surface of the packaged product. It is a further aim to provide an improved method of opening a packaging that conforms to the shape of the packaged product.

According to the present disclosure there is provided a confectionery packaging, a method of packaging a confectionery product, and a method of opening said confectionery packaging as set forth in the appended claims. Other features will be apparent from the dependent claims, and the description which follows.

In the exemplary embodiments a crack-propagation line is separate from a seal joining two parts of a confectionery packaging. The confectionery packaging is opened by breaking the packaging along the crack-propagation line such that a portion of at least one of the parts of the confectionery packaging is broken to form an opening through which the packaged confectionery can be removed.

The confectionery packaging is formed at least partially around a packaged confectionery by sealing the two parts. When sealed together, the two parts may form at least a partial enclosure for the packaged confectionery. The two parts may have a substantially constant wall thickness so that an external surface of the two parts substantially conforms to the shape of the packaged confectionery. Consequently, there is provided a method of forming a confectionery packaging and a method of packaging a confectionery product wherein two parts of a confectionery packaging are sealed together and a crack-propagation line is formed in a portion of at least one of the parts of the confectionery packaging. Suitably, the crack-propagation line extends away from the seal joining the two parts. In this case, the crack-propagation line being separate to the seal is still intended to cover situations where the crack propagation line extends through the seal or starts or finishes at the seal. The confectionery packaging is opened by separating at least one of the parts of the confectionery packaging, leaving the seal substantially unaffected. The additional step of forming a separate crack-propagation line rather than intending the confectionery packaging to be opened by separating the two parts through the seal provides improved opening characteristics.

Although the seal between the two parts may be formed in any known manner, for instance by adhering, welding or the like an opposed edge of each part to the other, in the exemplary embodiments, a first part of the confectionery packaging is joined to a second part of the confectionery packaging in face-to face relationship along said seal. Here, at least one, and preferably both of the first and second parts are shaped to extend away from a plane of the face-to-face seal. Preferably, in the exemplary embodiment, a portion of the seal is able to be gripped by a user, for instance first and second tabs can be formed. Here, the tabs are separated by or joined at or in close proximity to the crack-propagation line. Suitably, each tab includes a portion of the first and second parts. Consequently, separation along the crack-propagation line can be initiated or continued by pulling the tabs apart. In the exemplary embodiment, the confectionery packaging is opened by pulling the tabs in a direction parallel with the plane of the face-to-face seal.

Preferably, in one exemplary embodiment, said part of the confectionery packaging that includes the crack-propagation line is selected so that the material can be broken along the crack-propagation line with an audible crack.

Suitably, in the exemplary embodiments the material of the part of the confectionery packaging that includes the crack-propagation line is a thermoformed shell. For instance, the thermoformed shell may be fabricated by moulding the material in to a rigid shell. Preferably the crack-propagation line is formed after the thermoformed shell has been moulded for instance by laser ablation, die cutting or mechanical erosion. The thermo formed shell provides a substantially rigid packaging.

In the exemplary embodiments, the crack-propagation line does not penetrate through the packaging. In one embodiment, the part of the packaging having the crack-propagation line is formed from a multi-layer material. Here, the crack-propagation line is formed substantially through at least one of the layers, but does not penetrate through at least one of the remaining layers. Consequently, the crack-propagation line remains a substantial seal. It will be appreciated that it is the material breaking that can produce the audible crack when opened. In the case of the multi-layer material, it is therefore the properties of the intact layer or layers that are able to produce the audible sound.

In the exemplary embodiments, the crack-propagation line forms various paths suitable for forming the desired opening. For instance, the crack-propagation line may be straight or curved and may be divided in to a number of straight or curved sections each at an angle to adjoining sections, for example by forming a zigzag pattern. The crack-propagation line may be continuous or may be broken, for instance by being interrupted by a series of breaks in the crack-propagation line. Here, the crack would be encouraged to spread through the interruptions to the next part of the crack-propagation line.

Although a suitable opening may be formed using a crack-propagation line that extends through only one of the parts, in the exemplary embodiments, the crack-propagation line is formed in the first and second parts. Here, suitably, the crack-propagation line extends across the seal. The confectionery packaging separating into a first side having a portion of the first part and a portion of the second part joined at the seal, and a second side having a portion of the first part and a portion of the second part joined at the seal. The portion of the crack-propagation line in one of the parts may mirror the portion of the crack-propagation line in the other, for instance in a plane of a face-to-face seal between the two parts or orthogonal thereto. Alternatively, the portions of the crack propagation line in each part mat be identical so that each part may be the same.

In one exemplary embodiment, the crack-propagation line may be formed in a continuous loop to separate a first and second side of the crack-propagation line in to two separate pieces. Alternatively, in some exemplary embodiments, rather than forming a continuous loop, the crack-propagation line may terminate in ends. Here the ends may terminate at a position that is at least approximately half-way around the part from the start of the crack in that part, or at least two-thirds of the way around, or at least past the widest part of the packaging. Consequently, the packaging is encouraged to stay together as a single piece. Here the first and second pieces formed either side of the crack-propagation line may be pliable and able to bend along a fold line connecting two ends of the crack-propagation line. Additionally, and particularly suitable for embodiments where the joined parts form a complete enclosure around the packaged confectionery, the crack-propagation line may include a first branch. That is, one part of the crack-propagation line may continue in a different general direction to the other so that the crack-propagation line terminates in three or four or more than five ends. This can encourage the product to move through the opening.

In exemplary embodiments, a crack-initiation means is provided. The crack-initiation means may be in the form of a notch, or cut-out, or weakened area or other suitable means for initiating a crack to propagate along the crack-propagation line. The crack-initiation means may be formed in a shell part or in the area of the seal. Here, the crack-propagation line may extend from or through the crack-initiation means.

BRIEF DESCRIPTION OF THE FIGURES

For a better understanding of the disclosure, and to show how embodiments of the same may be carried into effect, reference will now be made, by way of example, to the accompanying diagrammatic drawings in which.

DETAILED DESCRIPTION

Figure 1A:
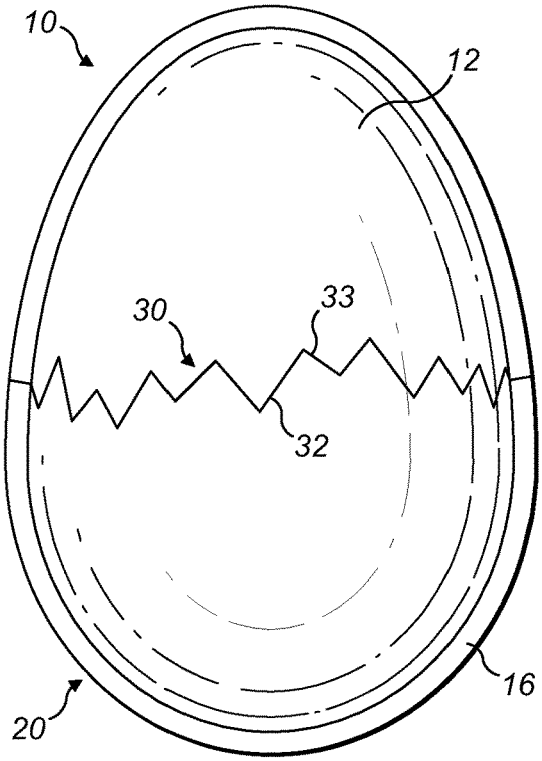
FIGS. 1*a* and 1*b* are front and end views of a confectionery packaging according to an exemplary embodiment.
Figure 1B:
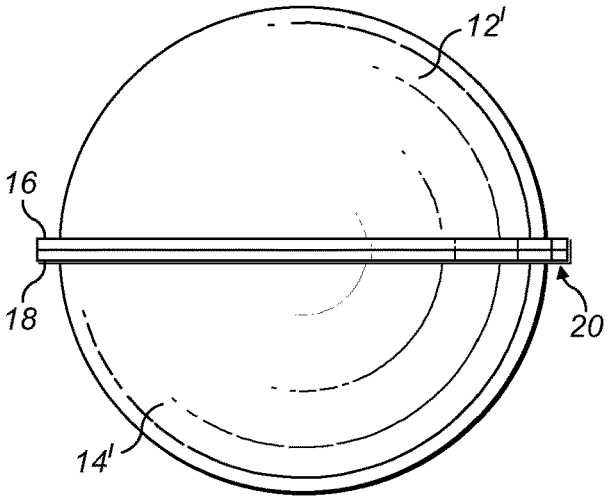

Referring to FIG. 1 an exemplary confectionery packaging 10 is shown. A first part 12 is sealed to a second part 14 at seal 20. The first part 12 is shown as an upper part 12' and the second part 14 a lower part 14'. However, this is not necessarily limiting and the confectionery packaging may be formed from three or more parts for instance. The parts are sealed together to enclose a packaged confectionery 40. The parts substantially conform to the shape of the packaged confectionery. A crack-propagation line 30 is formed in at least one of the parts. At least a part of the crack-propagation line 30 is separate to the seal and preferably, substantially all of the crack-propagation line is separate to the seal 20, as would be the case when the crack-propagation line extends through or starts at or partially along the seal. In other words, the crack-propagation line 30 is not substantially formed within the seal 20. In the exemplary embodiments, the crack-propagation line 30 extends away from the seal 20.

Forming the confectionery packaging from first and second parts enables graphics and the like to be printed or applied to the outside of the parts. This enables repeatable and clear graphics to be used. For instance, words and logos can be correctly formed even when the outside of the packaging is contoured. In contrast, when wrapping a packaged confectionery in foil, often words and logos are not easily distinguishable. In addition, because the packaging is completely sealed and cannot be opened without breaking, a tamper evident wrapping is provided.

The exemplary embodiments will be described in relation to a packaged confectionery being egg-shaped. Here, the confectionery packaging is formed from two shell-parts, where each shell-part forms substantially a half-egg. However, it will be appreciated that any shape applicable for the packaged product may be employed. Each shell-part may have a substantially constant thickness and may suitably be formed from casting, moulding, injection moulding, pressing or any other suitable technique, though thermoforming is particularly suitable particularly for food packaging. It will though be appreciated that constant thickness may include variations in thickness caused by manufacturing tolerances. The shell-parts 12, 14 are joined to form a sealed enclosure for the packaged confectionery. Typically, the confectionery is placed in one shell-part with the other being applied as a lid to close the packaged confectionery and subsequently sealed in place. The sealing may be via ultrasonic welding, cold welding, adhesive or any other suitable sealing means. In the exemplary embodiments, a face-to-face seal is used by providing a flange 16, 18 on each first and second shell-part 12, 14 respectively. The flanges 16, 18 can be formed as part of the moulding of the shell-parts. The flange extends around the open mouth of each shell part and substantially orthogonal to the direction of closure. The flanges 16, 18 can therefore be brought into face-to-face contact and sealed more easily, for instance by running an ultrasonic welding head and anvil along the top and bottom of the brought together flanges. In some instances it is preferable to conform the shape of the packaging 10 closely to the shape of the packaged confectionery 40. For instance, it may be preferable to reduce the size of the flanges 16, 18. Therefore, although the exemplary embodiments show the seal 20 between the shell-parts as being between a peripheral flange brought together face-to-face, in an extreme case, the flanges can be reduced to a substantially zero extension from the shell-parts with the edges of the opening about the shell-parts being sealed in an edge-to-edge relationship.

Figure 2:
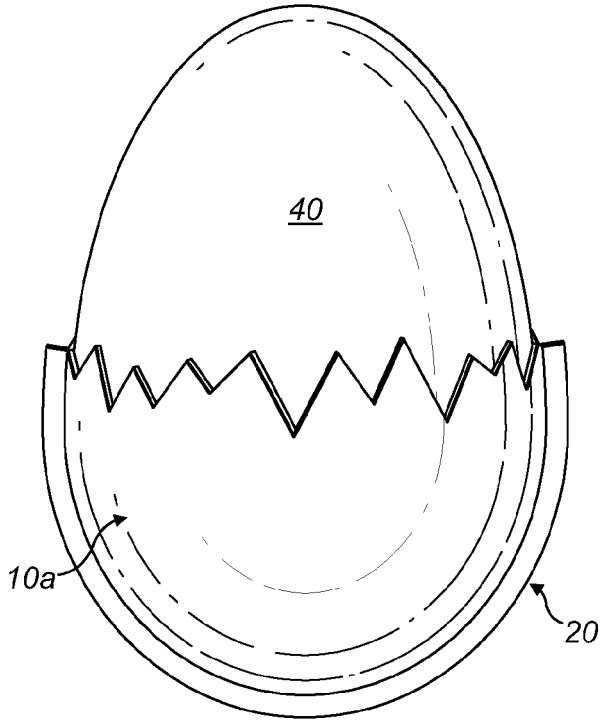
FIG. 2 is a perspective front view of an opened confectionery packaging of FIG. 1.

The crack-propagation line 30 is formed in at least a portion of one of the parts of the confectionery packaging. For instance, in the exemplary embodiment shown in FIG. 4, the crack-propagation line 30 extends through one part only. Also, whilst the crack-propagation line 30 in FIG. 4 may form a continuous band about the first part in order to separate the first part in to two sides, the crack-propagation line 30 may terminate in ends. Alternatively, in FIG. 1 for instance, the crack-propagation line 30 is shown as suitably being formed in both first and second shell-parts. Preferably, the crack-propagation line 30 extends away from the seal 20. In any case, the packaging is opened by breaking at least a portion of one of the parts along the crack-propagation line 30. For instance, in FIG. 1, the crack-propagation line 30 forms a band around the waist of the egg-shape so that when broken, one side of the packaging breaks completely from the other. As shown in FIG. 2, when the crack-propagation line 30 forms a band about the waist of the egg, a lower piece formed by a lower side 12*a* and a lower side 14*a* that remain sealed together at seal 20, provides a holder for the packaged confectionery.

The crack-propagation line 30 may take any suitable path to form an opening to remove the packaged confectionery from the packaging. Moreover, the crack-propagation line 30 may form a substantially straight path or a single substantially curved or arcuate path. In the exemplary embodiments, the crack-propagation line 30 is shown as taking a complex path made up of a plurality of path sections 32, 33. Each path section 32, 33 may be substantially straight or curved. Path sections 32, 33 are joined at an angle to form a zigzag or back and forth path. The zigzag path propagates in a general direction. The zigzag nature of the break line gives a more aesthetic break than, for example, separation along a seal, and is envisaged as being particularly relevant where the broken packaging resembles an actual fracture in an egg or rock for example. In the exemplary embodiments, the crack-propagation line 30 is continuous between each path section 32, 33. However, it is envisaged that breaks or interruptions in the crack-propagation line 30 may be provided between path sections, wherein the break would propagate across the interruption and continue to follow the crack-propagation line 30.

The crack-propagation line 30 may be formed by die-cutting or other mechanical abrasion technique. However, laser ablation has been found to be particularly effective. The mechanical abrasion or laser ablation can be used to weaken a score line in the material. However, it is preferable if the score does not penetrate completely through the shell-part in order to maintain a seal. In a particularly useful embodiment, a multi-layer material, such as a dual-layer material is used. The laser ablation or mechanical abrasion machines one or more of the layers but leaves one or more of the layers unaffected.

The properties and characteristics of the material or layer that is not or only partially machined is selected to break when an opening force is applied either side of the crack-propagation line 30. The material is encouraged to break along the crack-propagation line 30 because the thicker material elsewhere provides greater resistance to shearing than the thinned area at the crack-propagation line 30. In the exemplary embodiments, the material is designed not to break under normal forces except in the crack-propagation line 30. That is, when the break reaches the end of the crack-propagation line 30, under typical opening forces, the break is arranged to stop. Preferably, the material characteristics are selected so that the material breaks with an audible crack. That is, the material may be brittle so that a crack sound is heard when the material is broken. Additionally or alternatively, an audible crack may be produced from edges on opposed sides of the crack-propagation line moving past each other. The audible crack not only allows the consumer to know when the packaging has been opened, but also provides an enhanced opening ritual as it may encourage consumers to crack the packaging by tapping it on a surface, which is envisaged as being pertinent particularly for the egg-shaped packaged confection as it more closely mimics the opening of an actual fresh egg.

Figure 3A:
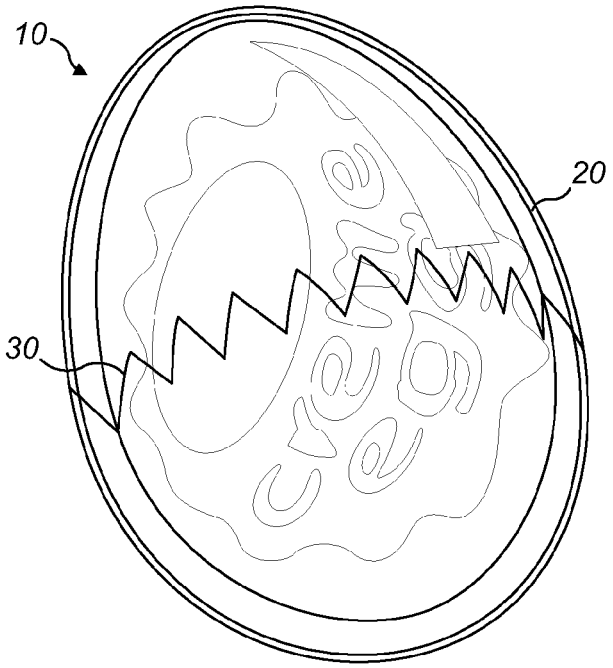
FIGS. 3*a*, 3*b*, and 3*c* show an opening sequence of the confectionery packaging of FIG. 1.
Figure 3B:
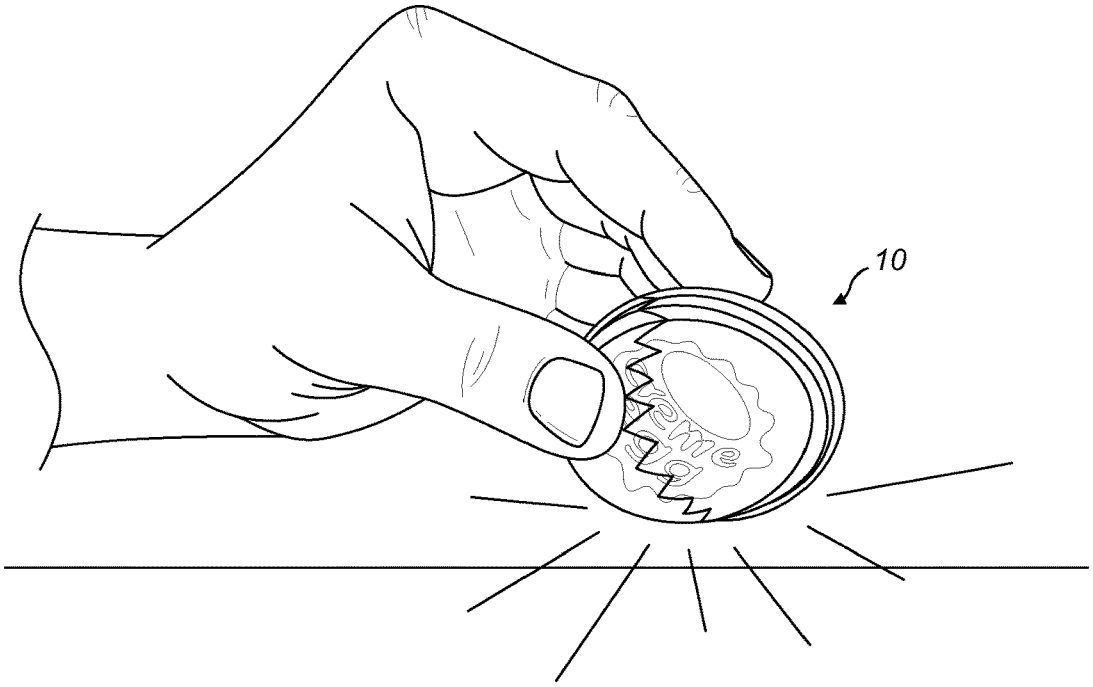
Figure 3C:
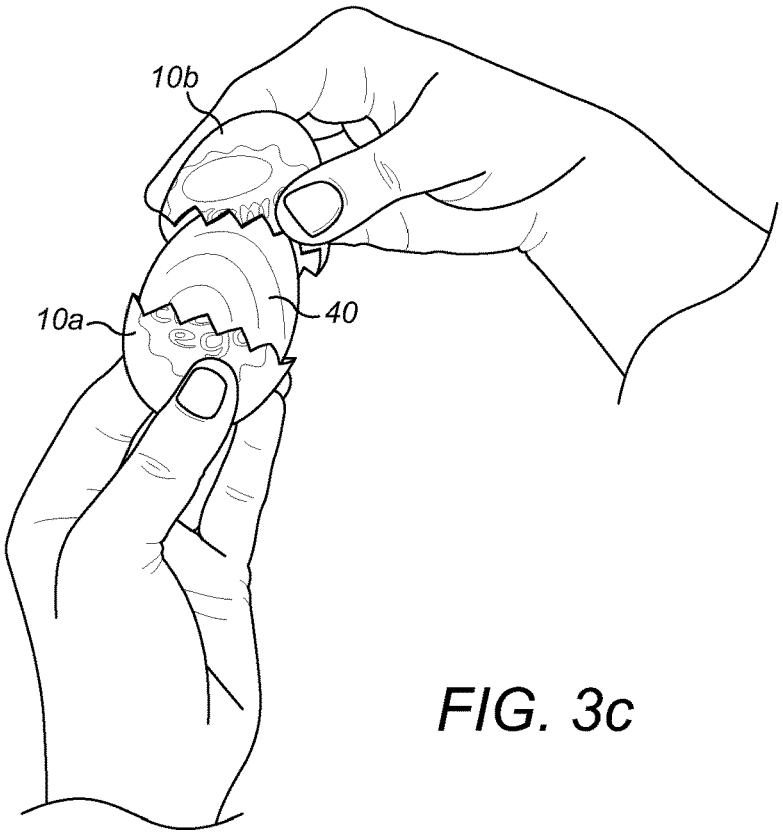

Referring to FIG. 3, an exemplary opening method of the confectionery packaging is depicted. The confectionery packaging 10 is provided having a first shell sealed to a second shell wherein a crack-propagation line 30 is provided separately to the seal 20. A consumer cracks the first and second shells along the crack-propagation line 30 by tapping the confectionery packaging on a surface. If the material is sufficiently brittle, an audible crack may be heard. Once the shells are broken along the crack-propagation line 30, one side of the confectionery packaging is separated from another side. One, for instance the top side, can be discarded and the second side used to hold the packaged confectionery 40. As alternative opening methods, it is envisaged that the consumer may grip the packaging either side of crack-propagation line and break the packaging along the crack-propagation line by a twisting action or snapping action. Additionally or alternatively, the consumer may push a part of the packaging inwards to cause a portion of the crack-propagation line to break before peeling backwards, twisting or snapping the packaging to cause the crack to propagate along the crack-propagation line. For instance, the consumer may push a portion of a side or the packaging. Here the portion may be at or near the seal. A crack-initiation means such as a notch or area may be formed in the packaging so as to provide a convenient are for a consumer to push their fingers or thumbs in order to part the packaging. Advantageously, and particularly when the packaging has a substantially ovoid exterior shape, the opening method is designed to mimic the opening of an actual egg.

Figure 4A:
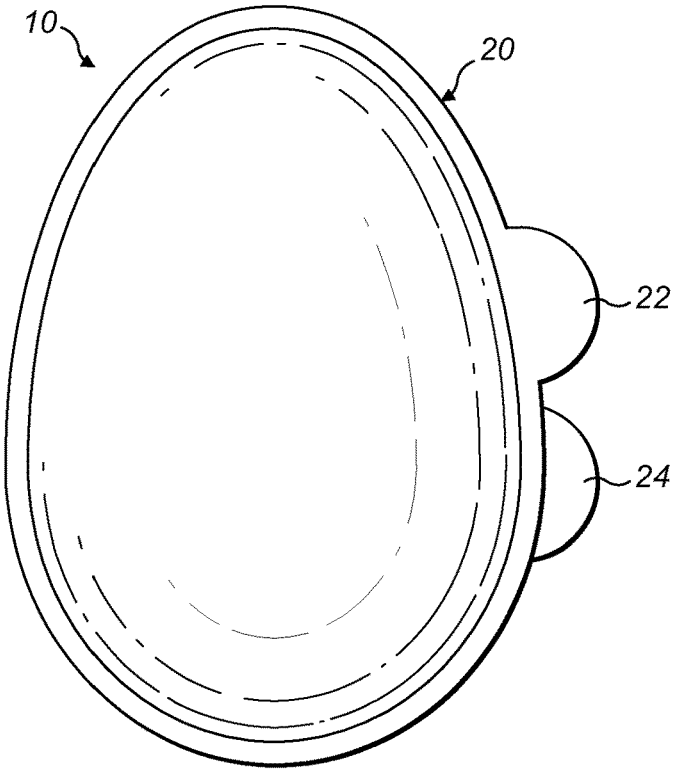
FIGS. 4*a* and 4*b* show front and side views of a confectionery packaging according to a second exemplary embodiment.
Figure 4B:
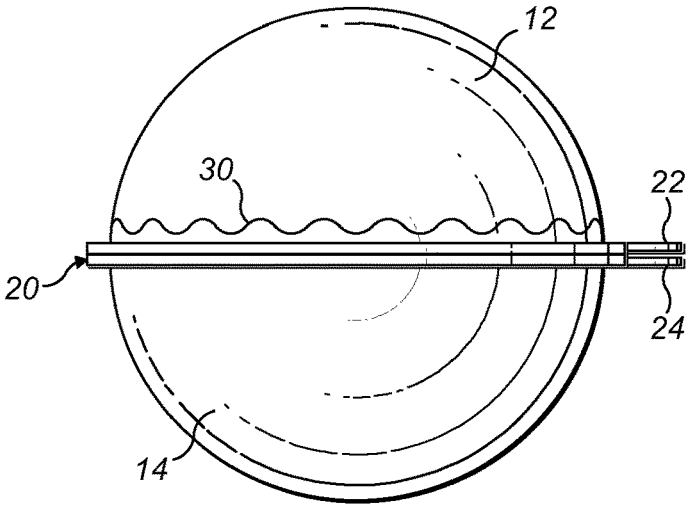

FIG. 4 shows an alternative exemplary embodiment. Here, as mentioned, the crack-propagation line 30 is formed in one part only. Also, the crack-propagation line 30 extends in a general direction substantially parallel to the seal 20. In this case the packaging can be opened by breaking through the crack-propagation line 30 or by peeling one side away from the other. To improve the ease of opening, at least one tab 22 may be formed. The tab 22 extends from the first shell-piece 12. The tab extends from close proximity to the crack-propagation line 30 so that by pulling the tab 22, the shell piece can be separated into two sides. The breaking of the material along the crack-propagation line 30 may also make an audible crack when initially broken, for instance, the initial break can be made by tapping the packaging on a surface or by pulling two sides of crack-propagation line 30 apart. As mentioned, the crack-propagation line 30 may extend around the first shell-piece 12, in which case a side is completely broken off, or the crack-propagation line 30 may terminate in ends. Here, a crease between the two ends of the crack-propagation line 30 may be flexible to allow the side to fold out of the way to enable the packaged confectionery 40 to be removed.

Preferably, as shown in FIG. 4, two tabs 22, 24 are formed. The second tab 24 remains attached to one side of the crack-propagation line 30 and the first tab 22 attached to the other so that the tabs can be pulled apart to easily initiate opening. Consequently, the tabs are off-set from each other. Each tab may form an enlarged portion of the peripheral flange that extends about the mouth of each shell part.

Figure 5:
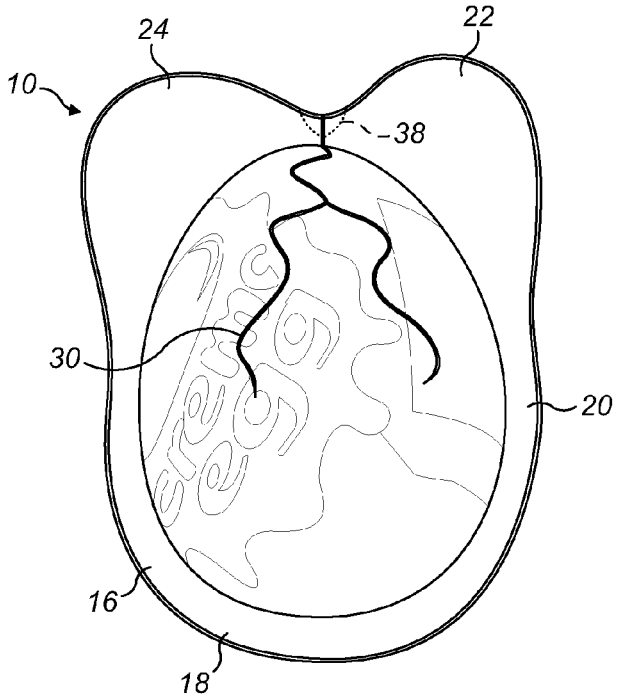
FIG. 5 shows a front perspective view of a confectionery packaging according to a third exemplary embodiment.

FIG. 5 shows a particularly exemplary embodiment of the confectionery packaging 10. The confectionery packaging is formed from a first shell-part 12 and a second shell part 24 sealed together at seal 20. A separate crack-propagation line 30 is provided. The packaging is arranged to open by breaking along the crack-propagation line 30.

As shown in FIG. 5, the shell-parts are sealed in a face-to-face relationship between respective flanges 16, 18 that extend about the periphery of the open shell-part. Although the extension of the flanges from the shell-piece may be kept to a minimum, two tabs may be provided. For instance, in FIG. 5, a tabs 22 and 24 are provided. Here, the tabs are formed in the seal and each tab included a portion of the first shell-part and a portion of the second shell-part. The crack-propagation line 30 extends away from the seal 20. In FIG. 5, the crack-propagation line 30 is shown in the first shell part, but it will be appreciated that the crack-propagation line 30 continues and is mirrored in the second shell-part. The two tabs are separated by the crack-propagation line 30 such that by pulling the tabs apart, the shell-parts can be broken along the crack-propagation line 30. Again, the break may be initiated by tapping the packaging 10 on a surface and the break may make an audible crack.

As will be appreciated, the crack-propagation line 30 shown in FIG. 5 may be any path and may be continuous around the packaging or, as shown may terminate in ends so that the two sides of the crack-propagation line 30 do not entirely separate. In addition, suitably as shown in FIG. 5, the crack-propagation line 30 may include at least one branch so that the crack-propagation line 30 terminates in at least three ends. Here, the branch may form a substantially 'Y' shape, as shown. That is, both branches may be angled to the general direction of a trunk. As will be described, the branch in the crack-propagation line 30 encourages the packaged confectionery to move through the formed opening.

Figure 6:
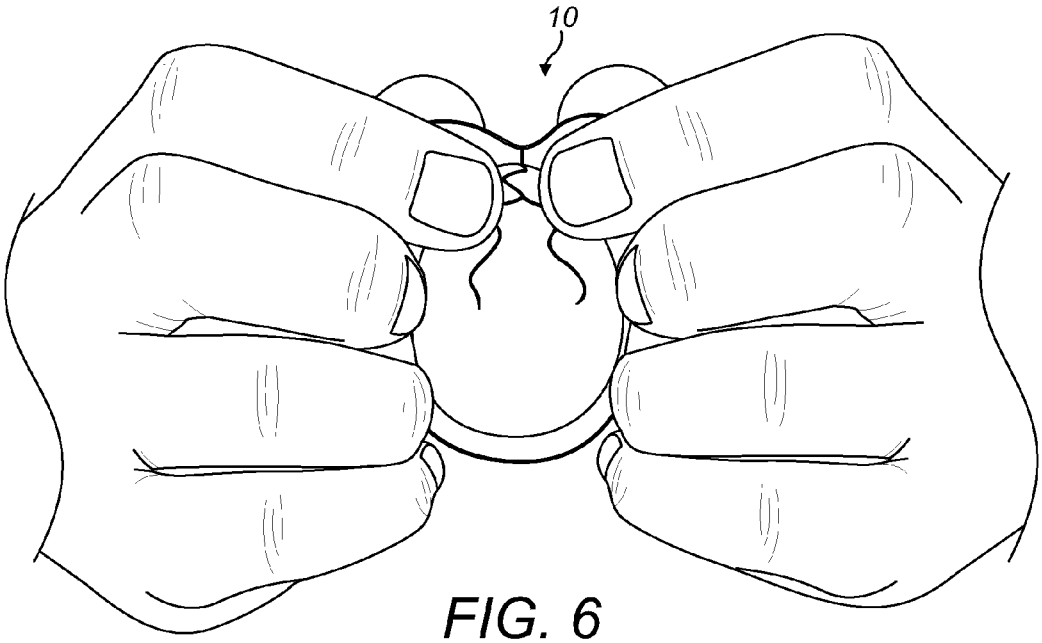
FIG. 6 shows an opening step to open the confectionery packaging of FIG. 5.
Figure 7:
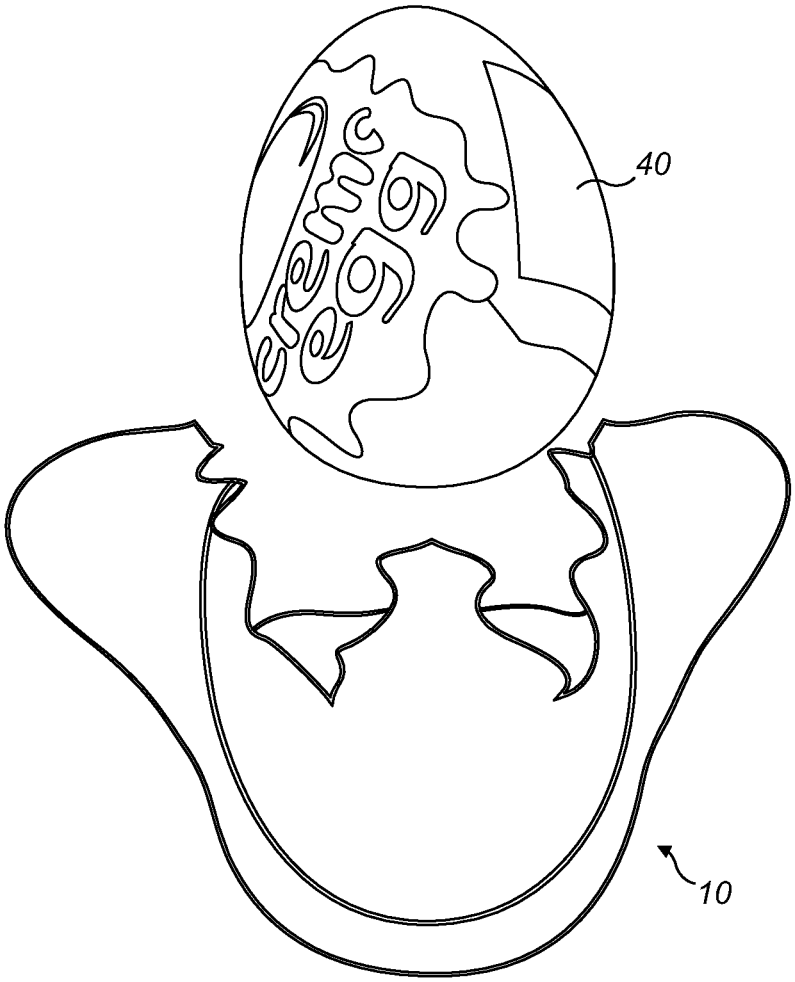
FIG. 7 shows an opened confectionery packaging of FIG. 5.

FIG. 6 shows an opening step of the packaging shown in FIG. 5. A consumer grasps both tabs, typically between a thumb and forefinger. By pulling apart the tabs in a direction parallel to the plane of the face-to-face seal, the crack-propagation line 30 can be broken. Because each tab is formed from portions of both shell parts, by gripping the tabs, a squeezing force is applied across the seal and acts to encourage the seal to stay intact. Also, because the tabs are pulled apart parallel to the plane of the seal, the force acting to separate the seal is minimal. Typically, the break occurs between the tabs, which is around the centre of the crack-propagation line 30 and propagates outwardly along the trunk and each branch of the crack-propagation line 30. When the break reaches the ends of the crack-propagation line 30, the sides of the packaging tend to fold outwardly as the two tabs are moved further apart. Suitably, either the consumers remaining fingers that automatically come together under the packaging, or, as the sides of the packaging fold, pressure from the packaging cause the packaged confectionery to move through the opening relative to the packaging. Suitably, the crack-propagation line 30 extends from the tip of the egg-shape and past a waist of the egg-shape. For instance, in the exemplary embodiments, the crack-propagation line 30 extends over half or over two thirds of the distance from one side of the packaging to the other.

In the exemplary embodiments, a crack-initiation means may be provided. For instance, referring to FIG. 5, an optional crack-initiation means 38 is shown in dotted line. The crack-initiation means 38 may be any suitable form, but is shown in FIG. 5 as being a notch. The notch is substantially wedge shaped with the convergent edges directed to or terminating at the crack-propagation line.

The exemplary embodiments provide an improved confectionery packaging. However, the exemplary embodiments are not restricted to confectionery packaging and may prove suitable for other edible food products such as meats or cheeses or the like. Also, for the sake of clarity, although the exemplary embodiments have been described in relation to an egg-shaped packaging, other shapes are envisaged. For instance, square, rectangular, circular, triangular or any other geometric shape may be employed to suit the given requirements. Also, the sides may be substantially straight rather than curved or contoured.

The exemplary embodiments provide shaped packaging formed from two or more sealed shells that can be opened in an easy and fun method. For instance, because the packaging is arranged to open by breaking the shells along the crack-propagation line whilst leaving the seal substantially unaffected, the material may be selected to emit an audible crack when the material breaks. Also, because the crack-propagation line may extend away from the seal, the packaging is arranged to open in an easy and convenient manner.

Although preferred embodiment(s) of the present invention have been shown and described, it will be appreciated by those skilled in the art that changes may be made without departing from the scope of the invention as defined in the claims.

The invention claimed is:

1. Packaging for a confectionery product, including a confectionery product packaged within the packaging, the packaging comprising:

a first part;

a first flange extending at an angle from the first part;

a second part; and a second flange extending at an angle from the second part, wherein the first and second parts substantially conform closely to the shape and contour of an outer surface the confectionery product to be packaged in the packaging such that the confectionery product substantially fills the first and second parts of the packaging;

an opening-propagation line formed in at least a portion of at least one of the parts, the opening-propagation line being arranged to break to form an opening to the confectionery packaging, wherein the first flange is sealed to the second flange to form a seal between the first part and the second part, wherein at least a part of the opening-propagation line is separate from the seal, such that the packaging is openable while leaving the seal substantially unaffected, wherein the opening-propagation line is a weakening in at least a portion of at least one of the parts, and wherein the part including the opening-propagation line is formed from a first layer and a second layer, and the opening-propagation line is not formed in one of the layers.

2. The packaging of claim 1, wherein the opening-propagation line extends away from the seal.

3. The packaging of claim 1, wherein the first and second parts are thermoformed shells.

4. The packaging of claim 1, wherein a opening-initiation means is formed in the seal area and the opening-propagation line extends from or through the opening-initiation means.

5. The packing of claim 1, wherein the opening-propagation line extends through at least a portion of both the first part and at least a portion of the second part.

6. The packaging of claim 5, wherein a portion of the opening-propagation line in the first part mirrors a portion of the opening-propagation line in the second part.

7. The packaging of claim 5, wherein the opening-propagation line is arranged so that when broken, one side of the opening-propagation line includes a portion of the first part sealed to a portion of the second part, and the other side includes a further portion of the first part sealed to a further portion of the second part.

8. The packaging of claim 1, wherein the opening-propagation line forms a continuous band around the confectionery packaging.

9. The packaging of claim 1, wherein the opening-propagation line terminates in at least two ends.

10. The packaging of claim 9, wherein first and second pieces formed either side of the opening-propagation line are pliable and able to bend along a fold line formed or formable between, and connecting, the two ends of the opening-propagation line.

11. The packaging of claim 9, wherein the two ends allow a flexible crease to be formed between the two ends in order to allow a piece to be folded out of the way to enable packaged confectionery to be removed.

12. The packaging of claim 1, wherein the opening-propagation line includes at least one branch.

13. The packaging of claim 1, wherein at least one tab is provided, wherein the tab provides a grip for a consumer to use to open the packaging.

14. The packaging of claim 13, wherein two tabs are provided spaced in a direction of the seal's plane, wherein each tab provides a grip for a consumer to use, the tabs being arranged so that the packaging is opened by parting the tabs.

15. The packaging of claim 1, wherein an exterior shape of the confectionery packaging is substantially ovoid.

16. The packaging of claim 1, wherein the continuous opening-propagation line allows a piece of the packaging to be completely broken off.

17. The packaging of claim 1, wherein the opening-propagation line comprises a crack-propagation line.

18. The packaging of claim 1, wherein the opening propagation line extends across the seal at the first flange and the second flange.

19. Packaging for a confectionery product, the packaging comprising:

a first part;

a first flange extending at an angle from the first part;

a second part; and a second flange extending at an angle from the second part, wherein the first flange is sealed to the second flange to form a seal between the first part and the second part, wherein the first and second parts substantially conform closely to the shape and contour of an outer surface of the confectionery product to be packaged in the packaging such that the confectionery product substantially fills the first and second parts of the packaging;

an opening-propagation line, wherein at least a part of the opening-propagation line is separate to the seal; and a first tab along the first flange and a second tab along the second flange, the first tab and the second tab being spaced in a direction parallel to a plane of the seal, wherein the opening-propagation line extends away from the seal, wherein the seal is where the first part and the second part initially separate to one another, have been joined to one another, and the opening-propagation line is a weakening in at least a portion of at least one of the parts, and wherein the part including the opening-propagation line is formed from a first layer and a second layer, and the opening-propagation line is not formed in one of the layers.

20. The packaging of claim 19, wherein the opening propagation line is present in both the first part and the second part.

21. A method of forming packaging for a confectionery product, the method, comprising:

forming a first part and a first flange extending at an angle from the first part;

forming a second part and a second flange extending at an angle from the second part;

creating an opening-propagation line in at least a portion of at least one of the parts; and sealing the first flange to the second flange to create a seal between the first part and the second part, wherein the first and second parts substantially conform closely to the shape and contour of an outer surface of the confectionery product such that the confectionery product substantially fills the first and second parts, wherein the seal is where the first part and the second part initially separate to one another, have been joined to one another, and the opening-propagation line is a weakening in at least a portion of at least one of the parts, and wherein the part including the opening-propagation line is formed from a first layer and a second layer, and the opening-propagation line is not formed in one of the layers.

22. The packaging of claim 21, wherein the opening propagation line extends across the seal at the first flange and the second flange.

23. A method of packaging a confectionery product, the method comprising:

forming a first part and a first flange extending at an angle from the first part;

forming a second part and a second flange extending at an angle from the second part;

creating an opening-propagation line in at least a portion of at least one of the parts;

arranging the confectionery product in the first part such that the first and second parts substantially closely conform to the shape and contour of an outer surface of the confectionery product such that the confectionery product substantially fills the first and second parts; and sealing the first flange to the second flange to form a seal between the first part and the second part, wherein the seal is where the first part and the second part initially separate to one another, have been joined to one another, and the opening-propagation line is a weakening in at least a portion of at least one of the parts, wherein the opening propagation line is present in both the first part and the second part, and wherein the part including the opening-propagation line is formed from a first layer and a second layer, and the opening-propagation line is not formed in one of the layers.

24. The packaging of claim 23, wherein the opening propagation line extends across the seal at the first flange and the second flange.

25. A method of producing packaging for a confectionery product, the method comprising:

forming a first part and a first flange extending at an angle from the first part;

forming a second part and a second flange extending at an angle from the second part;

arranging a confectionery product in the first part;

sealing the second flange to the first flange to provide a closed package with a seal between the first part and the second part;

wherein one of the first or second parts includes an opening-propagation line formed therein; and wherein the first and second parts substantially conform closely to the shape and contour of an outer surface of the confectionery product such that the confectionery product substantially fills the first and second parts, wherein the seal is where the first part and the second part initially separate to one another, have been joined to one another, and the opening-propagation line is a weakening in at least a portion of at least one of the parts, wherein the opening propagation line is present in both the first part and the second part, and wherein the part including the opening-propagation line is formed from a first layer and a second layer, and the opening-propagation line is not formed in one of the layers.

26. The packaging of claim 25, wherein the opening propagation line extends across the seal at the first flange and the second flange.

27. Packaging for a confectionery product, including a confectionery product packaged within the packaging, the packaging comprising:

a first part;

a first flange extending at an angle from the first part;

a second part; and a second flange extending at an angle from the second part, wherein the first and second parts substantially conform closely to the shape and contour of an outer surface the confectionery product to be packaged in the packaging such that the confectionery product substantially fills the first and second parts of the packaging;

an opening-propagation line formed in at least a portion of at least one of the parts, the opening-propagation line being arranged to break to form an opening to the confectionery packaging, wherein the first flange is sealed to the second flange to form a seal between the first part and the second part, wherein at least a part of the opening-propagation line is separate from the seal, such that the packaging is openable while leaving the seal substantially unaffected, wherein the opening-propagation line is a weakening in at least a portion of at least one of the parts, wherein the opening-propagation line terminates in at least two ends, and wherein first and second pieces formed either side of the opening-propagation line are pliable and able to bend along a fold line formed or formable between, and connecting, the two ends of the opening-propagation line.

28. Packaging for a confectionery product, including a confectionery product packaged within the packaging, the packaging comprising:

a first part;

a first flange extending at an angle from the first part;

a second part; and a second flange extending at an angle from the second part, wherein the first and second parts substantially conform closely to the shape and contour of an outer surface the confectionery product to be packaged in the packaging such that the confectionery product substantially fills the first and second parts of the packaging;

an opening-propagation line formed in at least a portion of at least one of the parts, the opening-propagation line being arranged to break to form an opening to the confectionery packaging, wherein the first flange is sealed to the second flange to form a seal between the first part and the second part, wherein at least a part of the opening-propagation line is separate from the seal, such that the packaging is openable while leaving the seal substantially unaffected, wherein the opening-propagation line is a weakening in at least a portion of at least one of the parts, wherein the opening-propagation line terminates in at least two ends, and wherein the two ends allow a flexible crease to be formed between the two ends in order to allow a piece to be folded out of the way to enable packaged confectionery to be removed.

29. Packaging for a confectionery product, the packaging comprising:

a first part;

a first flange extending at an angle from the first part;

a second part; and a second flange extending at an angle from the second part, wherein the first flange is sealed to the second flange to form a seal between the first part and the second part, wherein the first and second parts substantially conform closely to the shape and contour of an outer surface of the confectionery product to be packaged in the packaging such that the confectionery product substantially fills the first and second parts of the packaging;

an opening-propagation line, wherein at least a part of the opening-propagation line is separate to the seal; and a first tab along the first flange and a second tab along the second flange, the first tab and the second tab being spaced in a direction parallel to a plane of the seal, wherein the opening-propagation line extends away from the seal, wherein the seal is where the first part and the second part initially separate to one another, have been joined to one another, and the opening-propagation line is a weakening in at least a portion of at least one of the parts, wherein the opening-propagation line terminates in at least two ends, and wherein first and second pieces formed either side of the opening-propagation line are pliable and able to bend along a fold line formed or formable between, and connecting, the two ends of the opening-propagation line.

30. Packaging for a confectionery product, the packaging comprising:

a first part;

a first flange extending at an angle from the first part;

a second part; and a second flange extending at an angle from the second part, wherein the first flange is sealed to the second flange to form a seal between the first part and the second part, wherein the first and second parts substantially conform closely to the shape and contour of an outer surface of the confectionery product to be packaged in the packaging such that the confectionery product substantially fills the first and second parts of the packaging;

an opening-propagation line, wherein at least a part of the opening-propagation line is separate to the seal; and a first tab along the first flange and a second tab along the second flange, the first tab and the second tab being spaced in a direction parallel to a plane of the seal, wherein the opening-propagation line extends away from the seal, wherein the seal is where the first part and the second part initially separate to one another, have been joined to one another, and the opening-propagation line is a weakening in at least a portion of at least one of the parts, wherein the opening-propagation line terminates in at least two ends, and wherein the two ends allow a flexible crease to be formed between the two ends in order to allow a piece to be folded out of the way to enable packaged confectionery to be removed.

31. A method of forming packaging for a confectionery product, the method, comprising:

forming a first part and a first flange extending at an angle from the first part;

forming a second part and a second flange extending at an angle from the second part;

creating an opening-propagation line in at least a portion of at least one of the parts; and sealing the first flange to the second flange to create a seal between the first part and the second part, wherein the first and second parts substantially conform closely to the shape and contour of an outer surface of the confectionery product such that the confectionery product substantially fills the first and second parts, wherein the seal is where the first part and the second part initially separate to one another, have been joined to one another, and the opening-propagation line is a weakening in at least a portion of at least one of the parts, wherein the opening-propagation line terminates in at least two ends, and wherein first and second pieces formed either side of the opening-propagation line are pliable and able to bend along a fold line formed or formable between, and connecting, the two ends of the opening-propagation line.

32. A method of forming packaging for a confectionery product, the method, comprising:

forming a first part and a first flange extending at an angle from the first part;

forming a second part and a second flange extending at an angle from the second part;

creating an opening-propagation line in at least a portion of at least one of the parts; and sealing the first flange to the second flange to create a seal between the first part and the second part, wherein the first and second parts substantially conform closely to the shape and contour of an outer surface of the confectionery product such that the confectionery product substantially fills the first and second parts, wherein the seal is where the first part and the second part initially separate to one another, have been joined to one another, and the opening-propagation line is a weakening in at least a portion of at least one of the parts, wherein the opening-propagation line terminates in at least two ends, and wherein the two ends allow a flexible crease to be formed between the two ends in order to allow a piece to be folded out of the way to enable packaged confectionery to be removed.

33. A method of packaging a confectionery product, the method comprising:

forming a first part and a first flange extending at an angle from the first part;

forming a second part and a second flange extending at an angle from the second part;

creating an opening-propagation line in at least a portion of at least one of the parts;

arranging the confectionery product in the first part such that the first and second parts substantially closely conform to the shape and contour of an outer surface of the confectionery product such that the confectionery product substantially fills the first and second parts; and sealing the first flange to the second flange to form a seal between the first part and the second part, wherein the seal is where the first part and the second part initially separate to one another, have been joined to one another, and the opening-propagation line is a weakening in at least a portion of at least one of the parts, wherein the opening propagation line is present in both the first part and the second part, wherein the opening-propagation line terminates in at least two ends, and wherein first and second pieces formed either side of the opening-propagation line are pliable and able to bend along a fold line formed or formable between, and connecting, the two ends of the opening-propagation line.

34. A method of packaging a confectionery product, the method comprising:

forming a first part and a first flange extending at an angle from the first part;

forming a second part and a second flange extending at an angle from the second part;

creating an opening-propagation line in at least a portion of at least one of the parts;

arranging the confectionery product in the first part such that the first and second parts substantially closely conform to the shape and contour of an outer surface of the confectionery product such that the confectionery product substantially fills the first and second parts; and sealing the first flange to the second flange to form a seal between the first part and the second part, wherein the seal is where the first part and the second part initially separate to one another, have been joined to one another, and the opening-propagation line is a weakening in at least a portion of at least one of the parts, wherein the opening propagation line is present in both the first part and the second part, wherein the opening-propagation line terminates in at least two ends, and wherein the two ends allow a flexible crease to be formed between the two ends in order to allow a piece to be folded out of the way to enable packaged confectionery to be removed.

35. A method of producing packaging for a confectionery product, the method comprising:

forming a first part and a first flange extending at an angle from the first part;

forming a second part and a second flange extending at an angle from the second part;

arranging a confectionery product in the first part;

sealing the second flange to the first flange to provide a closed package with a seal between the first part and the second part;

wherein one of the first or second parts includes an opening-propagation line formed therein; and wherein the first and second parts substantially conform closely to the shape and contour of an outer surface of the confectionery product such that the confectionery product substantially fills the first and second parts, wherein the seal is where the first part and the second part initially separate to one another, have been joined to one another, and the opening-propagation line is a weakening in at least a portion of at least one of the parts, wherein the opening propagation line is present in both the first part and the second part, wherein the opening-propagation line terminates in at least two ends, and wherein first and second pieces formed either side of the opening-propagation line are pliable and able to bend along a fold line formed or formable between, and connecting, the two ends of the opening-propagation line.

36. A method of producing packaging for a confectionery product, the method comprising:

forming a first part and a first flange extending at an angle from the first part;

forming a second part and a second flange extending at an angle from the second part;

arranging a confectionery product in the first part;

sealing the second flange to the first flange to provide a closed package with a seal between the first part and the second part;

wherein one of the first or second parts includes an opening-propagation line formed therein; and wherein the first and second parts substantially conform closely to the shape and contour of an outer surface of the confectionery product such that the confectionery product substantially fills the first and second parts, wherein the seal is where the first part and the second part initially separate to one another, have been joined to one another, and the opening-propagation line is a weakening in at least a portion of at least one of the parts, wherein the opening propagation line is present in both the first part and the second part, wherein the opening-propagation line terminates in at least two ends, and wherein the two ends allow a flexible crease to be formed between the two ends in order to allow a piece to be folded out of the way to enable packaged confectionery to be removed.

* * * * *